US010910126B2

(12) United States Patent
Kusakari et al.

(10) Patent No.: US 10,910,126 B2
(45) **Date of Patent: *Feb. 2, 2021**

(54) ALUMINUM ALLOY WIRE, ALUMINUM ALLOY STRAND WIRE, COVERED ELECTRICAL WIRE, AND TERMINAL-EQUIPPED ELECTRICAL WIRE

(71) Applicants: SUMITOMO ELECTRIC INDUSTRIES, LTD., Osaka (JP); AUTONETWORKS TECHNOLOGIES, LTD., Yokkaichi (JP); SUMITOMO WIRING SYSTEMS, LTD., Yokkaichi (JP)

(72) Inventors: Misato Kusakari, Osaka (JP); Tetsuya Kuwabara, Osaka (JP); Yoshihiro Nakai, Osaka (JP); Taichiro Nishikawa, Osaka (JP); Yasuyuki Otsuka, Yokkaichi (JP); Hayato Ooi, Yokkaichi (JP)

(73) Assignees: Sumitomo Electric Industries, Ltd., Osaka (JP); AutoNetworks Technologies, Ltd., Yokkaichi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/346,420

(22) PCT Filed: Apr. 4, 2017

(86) PCT No.: PCT/JP2017/014044
§ 371 (c)(1),
(2) Date: Apr. 30, 2019

(87) PCT Pub. No.: WO2018/078911
PCT Pub. Date: May 3, 2018

(65) Prior Publication Data
US 2020/0066420 A1 Feb. 27, 2020

(30) Foreign Application Priority Data
Oct. 31, 2016 (JP) ..... 2016-213156

(51) Int. Cl.
*H01B 1/02* (2006.01)
*C22C 21/00* (2006.01)
(Continued)

(52) U.S. Cl.
CPC ..... *H01B 1/023* (2013.01); *C22C 21/00* (2013.01); *C22F 1/04* (2013.01); *H01B 5/08* (2013.01); *H01B 7/04* (2013.01); *H01R 4/185* (2013.01)

(58) Field of Classification Search
CPC combination set(s) only.
See application file for complete search history.

(56) References Cited

U.S. PATENT DOCUMENTS 6,441,308 B1 * 8/2002 Gagnon ..... H01B 7/295 174/105 R
9,994,945 B2 * 6/2018 Yoshida ..... C22F 1/00
(Continued)

FOREIGN PATENT DOCUMENTS

CN 102119233 A 7/2011
EP 2381001 A1 10/2011
(Continued)

OTHER PUBLICATIONS

"Organization of aluminum, property and Japan," Japan Institute of Light Metals, Nov. 30, 1991, pp. 376-396. [Cited in Office Action for corresponding JP 2016-213156.].
(Continued)

*Primary Examiner* — Binh B Tran
*Assistant Examiner* — Krystal Robinson
(74) *Attorney, Agent, or Firm* — Baker Botts L.L.P.; Michael A. Sartori

(57) ABSTRACT

An aluminum alloy contains equal to or more than 0.005 mass % and equal to or less than 2.2 mass % of Fe, and a remainder of Al and an inevitable impurity. In a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$.

12 Claims, 2 Drawing Sheets

(51) Int. Cl.

| | |
|---|---|
| ***C22F 1/04*** | (2006.01) |
| ***H01B 5/08*** | (2006.01) |
| ***H01B 7/04*** | (2006.01) |
| ***H01R 4/18*** | (2006.01) |

(56) References Cited

U.S. PATENT DOCUMENTS

| | | | | |
|---|---|---|---|---|
| 2005/0006132 | A1* | 1/2005 | Clark | H01B 7/184 174/113 C |
| 2009/0308633 | A1* | 12/2009 | Dion | H01B 13/262 174/113 R |
| 2010/0329614 | A1* | 12/2010 | Keller | G02B 6/4416 385/101 |
| 2011/0020662 | A1* | 1/2011 | Okamoto | B22F 3/105 428/566 |
| 2011/0140517 | A1 | 6/2011 | Kusakari et al. | |
| 2012/0217060 | A1 | 8/2012 | Kusakari et al. | |
| 2013/0011106 | A1* | 1/2013 | Congdon, II | G02B 6/4416 385/101 |
| 2014/0047942 | A1 | 2/2014 | Tsuda et al. | |
| 2014/0235116 | A1* | 8/2014 | Otsuka | H01R 4/62 439/877 |
| 2017/0253954 | A1* | 9/2017 | Yoshida | C22F 1/04 |
| 2019/0267152 | A1 | 8/2019 | Kusakari et al. | |

FOREIGN PATENT DOCUMENTS

| | | | |
|---|---|---|---|
| EP | 2383357 | A1 | 11/2011 |
| JP | S49-011530 | B | 3/1974 |
| JP | S58-217665 | A | 12/1983 |
| JP | S59-064573 | A | 4/1984 |
| JP | S60-018256 | A | 1/1985 |
| JP | 2003-303517 | A | 10/2003 |
| JP | 2010-067591 | A | 3/2010 |
| JP | 2012-229485 | A | 11/2012 |
| JP | 2015-005485 | A | 1/2015 |
| JP | 2015-124409 | A | 7/2015 |
| JP | 2015-166480 | A | 9/2016 |
| WO | 2010/082670 | A1 | 7/2010 |
| WO | 2010/082671 | A1 | 7/2010 |
| WO | 2016/088889 | A1 | 6/2016 |
| WO | 2016/088889 | A1 | 9/2016 |

OTHER PUBLICATIONS

Office Action, Japanese Application No. 2016-213156, dated Dec. 7, 2016, 8 pages.

Notice of Allowance issued in U.S. Appl. No. 16/346,479 dated Aug. 12, 2019.

* cited by examiner

ALUMINUM ALLOY WIRE, ALUMINUM ALLOY STRAND WIRE, COVERED ELECTRICAL WIRE, AND TERMINAL-EQUIPPED ELECTRICAL WIRE

TECHNICAL FIELD

The present invention relates to an aluminum alloy wire, an aluminum alloy strand wire, a covered electrical wire, and a terminal-equipped electrical wire.

The present application claims priority based on Japanese Patent Application No. 2016-213156 filed on Oct. 31, 2016, and incorporates the entire description in the Japanese application.

BACKGROUND ART

As a wire member suitable to a conductor for an electrical wire, PTL 1 discloses an aluminum alloy wire that contains an aluminum alloy as a specific composition and that is softened so as to have high strength, high toughness and high electrical conductivity and also to have excellent performance of fixation to a terminal portion.

CITATION LIST

Patent Literature

PTL 1: Japanese Patent Laying-Open No. 2010-067591

SUMMARY OF INVENTION

An aluminum alloy wire of the present disclosure is an aluminum alloy wire composed of an aluminum alloy.

The aluminum alloy contains equal to or more than 0.005 mass % and equal to or less than 2.2 mass % of Fe, and a remainder of Al and an inevitable impurity. In a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$.

The aluminum alloy wire has: a wire diameter equal to or more than 0.2 mm and equal to or less than 3.6 mm; tensile strength equal to or more than 110 MPa and equal to or less than 200 MPa; 0.2% proof stress equal to or more than 40 MPa; breaking elongation equal to or more than 10%; and electrical conductivity equal to or more than 55% IACS.

An aluminum alloy strand wire of the present disclosure includes a plurality of the aluminum alloy wires of the present disclosure, the plurality of the aluminum alloy wires being stranded together.

A covered electrical wire of the present disclosure includes: a conductor; and an insulation cover that covers an outer circumference of the conductor. The conductor includes the aluminum alloy strand wire of the present disclosure.

A terminal-equipped electrical wire of the present disclosure includes: the covered electrical wire of the present disclosure; and a terminal portion attached to an end portion of the covered electrical wire.

DETAILED DESCRIPTION

Figure 1:
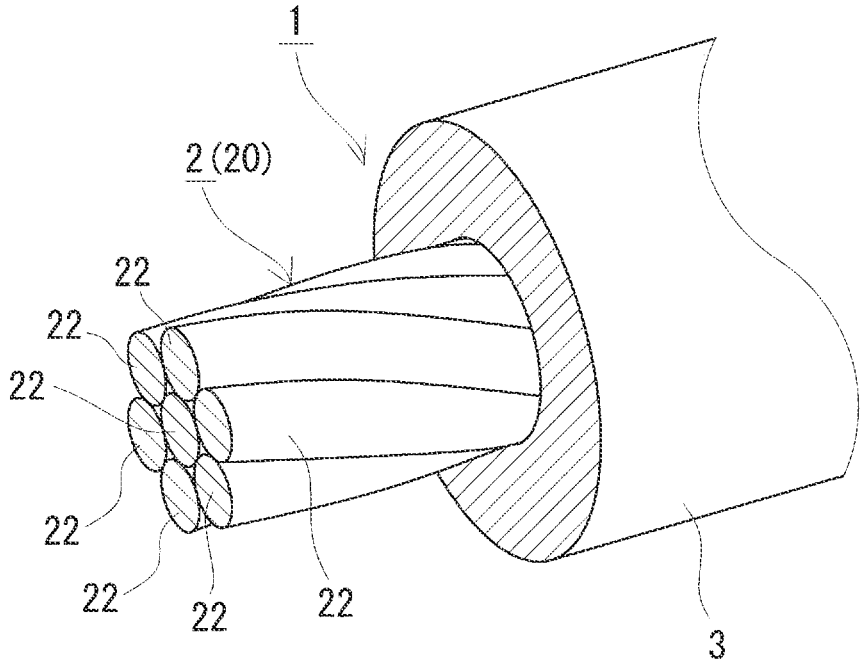
FIG. 1 is a schematic perspective view showing a covered electrical wire having a conductor including an aluminum alloy wire in an embodiment.

Problem to be Solved by the Present Disclosure

An aluminum alloy wire excellent in impact resistance and also excellent in fatigue characteristics is desired as a wire member utilized for a conductor or the like included in an electrical wire.

There are electrical wires for various uses such as wire harnesses placed in devices in an automobile, an airplane and the like, interconnections in various kinds of electrical devices such as an industrial robot, and interconnections in a building and the like. Such electrical wires may undergo an impact, repeated bending and the like during use, installation or the like of devices. The following are specific examples (1) to (3).

(1) It is conceivable that an electrical wire included in a wire harness for an automobile undergoes: an impact in the vicinity of a terminal portion, for example, during installation of an electrical wire to a subject to be connected (PTL 1); a sudden impact in accordance with the traveling state of an automobile; repeated bending by vibrations during traveling of an automobile; and the like.

(2) It is conceivable that an electrical wire routed in an industrial robot undergoes repeated bending, twisting or the like.

(3) It is conceivable that an electrical wire routed in a building undergoes: an impact due to sudden strong pulling or erroneous dropping by an operator during installation; repeated bending due to shaking in a wavelike motion for removing a curl from the wire member that has been wound in a coil shape; and the like.

Thus, it is desirable that the aluminum alloy wire used for a conductor and the like included in an electrical wire is less likely to be disconnected not only by an impact but also by repeated bending.

Accordingly, one object is to provide an aluminum alloy wire that is excellent in impact resistance and fatigue characteristics. Another object is to provide an aluminum alloy strand wire, a covered electrical wire and a terminal-equipped electrical wire that are excellent in impact resistance and fatigue characteristics.

Advantageous Effect of the Present Disclosure

The aluminum alloy wire of the present disclosure, the aluminum alloy strand wire of the present disclosure, the covered electrical wire of the present disclosure, and the terminal-equipped electrical wire of the present disclosure are excellent in impact resistance and fatigue characteristics.

The present inventors have manufactured aluminum alloy wires under various conditions and conducted a study about an aluminum alloy wire that is excellent in impact resistance and fatigue characteristics (less likely to be disconnected against repeated bending). The wire member that is made of an aluminum alloy having a specific composition containing Fe in a specific range and that is subjected to softening treatment has high strength (for example, high tensile strength and high 0.2% proof stress), high toughness (for example, high breaking elongation), excellent impact resistance, and also, high electrical conductivity so as to be excellent in electrical conductive property. The present inventors have found that such a wire member is excellent in impact resistance and also less likely to be disconnected by repeated bending if the surface layer of this wire member contains a smaller amount of voids. The present inventors also have found that the aluminum alloy wire having a surface layer containing a smaller amount of voids can be manufactured, for example, by controlling the temperature of melt of the aluminum alloy, which is to be subjected to casting, to fall within a specific range. The invention of the present application is based on the above-mentioned findings. The details of embodiments of the invention of the present application will be first listed as below for explanation.

DESCRIPTION OF EMBODIMENTS (1) An aluminum alloy wire according to one aspect of the invention of the present application is an aluminum alloy wire composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$.

The aluminum alloy wire has: a wire diameter equal to or more than 0.2 mm and equal to or less than 3.6 mm; tensile strength equal to or more than 110 MPa and equal to or less than 200 MPa; 0.2% proof stress equal to or more than 40 MPa; breaking elongation equal to or more than 10%; and electrical conductivity equal to or more than 55% IACS.

The transverse section of the aluminum alloy wire means a cross section cut along a plane orthogonal to the axis direction (the longitudinal direction) of the aluminum alloy wire.

The above-mentioned aluminum alloy wire (which may be hereinafter referred to as an Al alloy wire) is formed of an aluminum alloy (which may be hereinafter referred to as an Al alloy) having a specific composition. The above-mentioned aluminum alloy wire is subjected to softening treatment or the like in the manufacturing process, so that it has high strength and high toughness and is also excellent in impact resistance. Due to high strength and high toughness, the above-mentioned aluminum alloy wire can be smoothly bent, is less likely to be disconnected even upon repeated bending, and also, is excellent in fatigue characteristics. Particularly, the above-mentioned Al alloy wire has a surface layer containing a smaller amount of voids. Accordingly, even upon an impact, repeated bending or the like, voids are less likely to become origins of cracking, so that cracking resulting from voids is less likely to occur. Since surface cracking is less likely to occur, progress of cracking from the surface of the wire member toward the inside thereof and breakage of the wire member can be reduced. Thus, the above-mentioned Al alloy wire is excellent in impact resistance and fatigue characteristics. Furthermore, the above-mentioned Al alloy wire is less likely to undergo cracking resulting from voids. Accordingly, depending on the composition, the heat treatment conditions and the like, at least one selected from tensile strength, 0.2% proof stress and breaking elongation tends to be relatively higher than others in the tensile test, thereby also leading to excellent mechanical characteristics.

(2) An example of the above-mentioned Al alloy wire includes an embodiment in which, in the transverse section of the aluminum alloy wire, an inside void measurement region in a shape of a rectangle having a short side length of 30 μm and a long side length of 50 μm is defined such that a center of the rectangle of the inside void measurement region coincides with a center of the aluminum alloy wire, and a ratio of a total cross-sectional area of voids in the inside void measurement region to the total cross-sectional area of the voids in the surface-layer void measurement region is equal to or more than 1.1 and equal to or less than 44.

In the above-mentioned embodiment, the above-mentioned ratio of the total cross-sectional areas is equal to or more than 1.1. Thus, although the amount of voids inside the Al alloy wire is larger than that in the surface layer of the Al alloy wire, the above-mentioned ratio of the total cross-sectional areas falls within a specific range. Accordingly, it can be said that the amount of voids inside the Al alloy wire is also small. Therefore, in the above-mentioned embodiment, even upon an impact, repeated bending or the like, cracking is less likely to progress from the surface of the wire member toward the inside thereof through voids and less likely to be broken, thereby leading to more excellent impact resistance and fatigue characteristics.

(3) An example of the above-mentioned Al alloy wire includes an embodiment in which the aluminum alloy further contains equal to or less than 1.0 mass % in total of one or more elements selected from Mg, Si, Cu, Mn, Ni, Zr, Ag, Cr, and Zn in respective ranges of Mg: equal to or more than 0.05 mass % and equal to or less than 0.5 mass %, Si: equal to or more than 0.03 mass % and equal to or less than 0.3 mass %, Cu: equal to or more than 0.05 mass % and equal to or less than 0.5 mass %, and Mn, Ni, Zr, Ag, Cr, and Zn: equal to or more than 0.005 mass % and equal to or less than 0.2 mass % in total.

In the above-described embodiment, the above-mentioned elements each are contained in a specific range in addition to Fe, so that a further strength improvement and the like can be expected.

(4) An example of the above-mentioned Al alloy wire includes an embodiment in which the aluminum alloy further contains at least one of: equal to or more than 0 mass % and equal to or less than 0.05 mass % of Ti; and equal to or more than 0 mass % and equal to or less than 0.005 mass % of B.

In the case of Ti and B, the crystal grains are readily finely grained during casting. By using the cast material having a fine crystal structure as a base material, an Al alloy wire having a fine crystal structure is consequently readily achieved. In the above-mentioned embodiment, a fine crystal structure is included. Thus, upon an impact or repeated bending, breakage is less likely to occur, thereby leading to excellent impact resistance and fatigue characteristics.

(5) An example of the above-mentioned Al alloy wire includes an embodiment in which the aluminum alloy has an average crystal grain size equal to or less than 50 μm.

In the above-mentioned embodiment, in addition to a small amount of voids, crystal grains are finely grained and the flexibility is excellent, thereby leading to excellent impact resistance and fatigue characteristics.

(6) An example of the above-mentioned Al alloy wire includes an embodiment in which a work hardening exponent is equal to or more than 0.05.

In the above-mentioned embodiment, the work hardening exponent falls within a specific range. Thus, when a terminal portion is attached by pressure bonding or the like, it can be expected that the fixing force of the terminal portion by work hardening is improved. Accordingly, the above-mentioned embodiment can be suitably utilized for a conductor to which a terminal portion is attached, such as a terminal-equipped electrical wire.

(7) An example of the above-mentioned Al alloy wire includes an embodiment in which the aluminum alloy wire has a surface oxide film having a thickness of equal to or more than 1 nm and equal to or less than 120 nm.

In the above-mentioned embodiment, the thickness of the surface oxide film falls within a specific range. Accordingly, when a terminal portion is attached, the amount of oxide (that forms a surface oxide film) interposed between the terminal portion and the surface is small. Thus, the connection resistance can be prevented from increasing due to interposition of an excessive amount of oxide while excellent corrosion resistance can also be achieved. Accordingly, the above-mentioned embodiment can be suitably utilized for a conductor to which a terminal portion is attached, such as a terminal-equipped electrical wire. In this case, it becomes possible to implement a connection structure that is excellent in impact resistance and fatigue characteristics and also less resistant and excellent in corrosion resistance.

(8) An example of the above-mentioned Al alloy wire includes an embodiment in which a content of hydrogen is equal to or less than 4.0 ml/100 g.

The present inventors have examined the gas component contained in the Al alloy wire containing voids and have found that hydrogen is contained. Thus, one factor of voids occurring inside the Al alloy wire is considered as hydrogen. In the above-mentioned embodiment, the content of hydrogen is small, so that the amount of voids is also considered as being small. Accordingly, disconnection resulting from voids is less likely to occur, thereby leading to excellent impact resistance and fatigue characteristics.

(9) An aluminum alloy strand wire according to one aspect of the invention of the present application includes a plurality of the aluminum alloy wires described in any one of the above (1) to (8), the aluminum alloy wires being stranded together.

Each of elemental wires forming the above-mentioned aluminum alloy strand wire (which may be hereinafter referred to as an Al alloy strand wire) is formed of an Al alloy having a specific composition as described above and has a surface layer containing a small amount of voids, thereby leading to excellent impact resistance and fatigue characteristics. Furthermore, a strand wire is generally excellent in flexibility as compared with a solid wire having the same conductor cross-sectional area, and each of elemental wires thereof is less likely to be broken even upon an impact or repeated bending, thereby leading to excellent impact resistance and fatigue characteristics. In view of the above-described points, the above-mentioned Al alloy strand wire is excellent in impact resistance and fatigue characteristics. Each elemental wire is excellent in mechanical characteristics as described above. Accordingly, the above-mentioned Al alloy strand wire shows a tendency that at least one selected from tensile strength, 0.2% proof stress and breaking elongation is higher than others, thereby also leading to excellent mechanical characteristics.

(10) An example of the above-mentioned Al alloy strand wire includes an embodiment in which a strand pitch is equal to or more than 10 times and equal to or less than 40 times as large as a pitch diameter of the aluminum alloy strand wire.

The pitch diameter refers to the diameter of a circle that connects the respective centers of all of the elemental wires included in each layer of the strand wire having a multilayer structure.

In the above-mentioned embodiment, the strand pitch falls within a specific range. Thus, the elemental wires are less likely to be twisted during bending or the like, so that breakage is less likely to occur. Also, the elemental wires are less likely to be separated from each other during attachment of a terminal portion, so that the terminal portion is readily attached. Accordingly, the above-mentioned embodiment is particularly excellent in fatigue characteristics and also can be suitably utilized for a conductor to which a terminal portion is attached, such as a terminal-equipped electrical wire.

(11) A covered electrical wire according to one aspect of the invention of the present application is a covered electrical wire including: a conductor; and an insulation cover that covers an outer circumference of the conductor. The conductor includes the aluminum alloy strand wire described in the above (9) or (10).

Since the above-mentioned covered electrical wire includes a conductor formed of the above-mentioned Al alloy strand wire that is excellent in impact resistance and fatigue characteristics, it is excellent in impact resistance and fatigue characteristics.

(12) A terminal-equipped electrical wire according to one aspect of the invention of the present application includes: the covered electrical wire described in the above (11); and a terminal portion attached to an end portion of the covered electrical wire.

The above-mentioned terminal-equipped electrical wire is composed of components including a covered electrical wire having a conductor formed of the Al alloy wire and the Al alloy strand wire that are excellent in impact resistance and fatigue characteristics, thereby leading to excellent impact resistance and fatigue characteristics.

Details of Embodiment of the Invention of the Present Application

In the following, the embodiments of the invention of the present application will be described in detail appropriately with reference to the accompanying drawings, in which the components having the same name will be designated by the same reference characters. In the following description, the content of each element is shown by mass %.

[Aluminum Alloy Wire]

SUMMARY

An aluminum alloy wire (Al alloy wire) 22 in an embodiment is a wire member formed of an aluminum alloy (Al alloy), and representatively utilized for a conductor 2 and the like of an electrical wire (FIG. 1). In this case, Al alloy wire 22 is utilized in the state of: a solid wire; a strand wire (Al alloy strand wire 20 in the embodiment) formed by stranding a plurality of Al alloy wires 22 together; or a compressed strand wire (another example of Al alloy strand wire 20 in the embodiment) formed by compression-molding a strand wire into a prescribed shape. FIG. 1 illustrates Al alloy strand wire 20 formed by stranding seven Al alloy wires 22 together. Al alloy wire 22 in the embodiment has a specific composition in which an Al alloy contains Fe in a specific range, and also has a specific structure in which the amount of voids in the surface layer of Al alloy wire 22 is small. Specifically, the Al alloy forming Al alloy wire 22 in the embodiment is an Al—Fe-based alloy containing: equal to or more than 0.005% and equal to or less than 2.2% of Fe, and a remainder of Al and an inevitable impurity. Furthermore, Al alloy wire 22 in the embodiment has a transverse section, in which the total cross-sectional area of voids existing in the following region (referred to as a surface-layer void measurement region) that is defined within a surface layer region extending from the surface of Al alloy wire 22 by 30 μm in the depth direction is equal to or less than 2 $\mu m^2$. The surface-layer void measurement region is defined as a region in a shape of a rectangle having a short side length of 30 μm and a long side length of 50 μm. Al alloy wire 22 in the embodiment having the above-mentioned specific composition and having a specific structure is subjected to softening treatment or the like in the manufacturing process, so that it has high strength, high toughness and excellent impact resistance, and also can be reduced in breakage resulting from voids, thereby leading to more excellent impact resistance and fatigue characteristics.

The following is a more detailed explanation. The details of the method of measuring each parameter such as the size of a void and the details of the above-described effects will be described in Test Example.

(Composition)

Al alloy wire 22 in the embodiment is formed of an Al alloy containing 0.005% or more of Fe. Thus, Al alloy wire 22 can be increased in strength without excessive reduction in electrical conductivity. The higher Fe content leads to a higher strength of an Al alloy. Furthermore, Al alloy wire 22 is formed of an Al alloy containing Fe in a range equal to or less than 2.2%, which is less likely to cause reduction in electrical conductivity and toughness resulting from Fe content. Thus, this Al alloy wire 22 has high electrical conductivity, high toughness and the like, is less likely to be disconnected during wire drawing, and is also excellent in manufacturability. In consideration of the balance among the strength, the toughness and the electrical conductivity, the content of Fe can be set to be equal to or more than 0.1% and equal to or less than 2.0%, and equal to or more than 0.3% and equal to or less than 2.0%, and further, equal to or more than 0.9% and equal to or less than 2.0%.

When the Al alloy forming Al alloy wire 22 in the embodiment contains the following additive elements preferably in specific ranges as described later in addition to Fe, the mechanical characteristics such as strength and toughness can be expected to be improved, thereby leading to more excellent impact resistance and fatigue characteristics. The additive elements may be one or more types of elements selected from Mg, Si, Cu, Mn, Ni, Zr, Ag, Cr, and Zn. In the cases of Mg, Mn, Ni, Zr, and Cr, the electrical conductivity is greatly decreased but a high strength improving effect is achieved. Particularly when Mg and Si are contained simultaneously, the strength can be further enhanced. In the case of Cu, the electrical conductivity is less decreased and the strength can be further improved. In the cases of Ag and Zn, the electrical conductivity is less decreased and the strength improving effect is achieved to some extent. Due to improvement in strength, even after heat treatment such as softening treatment is performed, high breaking elongation and the like can be achieved while keeping high tensile strength and the like, thereby also contributing to improvement in impact resistance and fatigue characteristics. The content of each of the listed elements is equal to or more than 0% and equal to or less than 0.5%. The total content of the listed elements is equal to or more than 0% and equal to or less than 1.0%. Particularly when the total content of the listed elements is equal to or more than 0.005% and equal to or less than 1.0%, the above-mentioned effects of improving strength, impact resistance and fatigue characteristics and the like can be readily achieved. The following is an example of the content of each element. In the above-mentioned range of the total content and the following range of the content of each element, the higher contents are more likely to enhance the strength while the lower contents are more likely to increase the electrical conductivity.

(Mg) More than 0% and equal to or less than 0.5%, equal to or more than 0.05% and less than 0.5%, equal to or more than 0.05% and equal to or less than 0.4%, and equal to or more than 0.1% and equal to or less than 0.4%.

(Si) More than 0% and equal to or less than 0.3%, equal to or more than 0.03% and less than 0.3%, and equal to or more than 0.05% and equal to or less than 0.2%.

(Cu) Equal to or more than 0.05% and equal to or less than 0.5%, and equal to or more than 0.05% and equal to or less than 0.4%.

(Mn, Ni, Zr, Ag, Cr, and Zn, which may be hereinafter collectively referred to as an element a) Equal to or more than 0.005% and equal to or less than 0.2% in total, and equal to or more than 0.005% and equal to or less than 0.15% in total.

When the result of analyzing the components in pure aluminum used as a raw material shows that the raw material contains Fe as impurities and additive elements such as Mg as described above, the additive amount of each of the elements may be adjusted such that each of the contents of these elements becomes equal to a desired amount. In other words, the content of each additive element such as Fe shows a total amount including elements contained in the aluminum ground metal used as a raw material, and does not necessarily mean an additive amount.

The Al alloy forming Al alloy wire 22 in the embodiment can contain at least one element of Ti and B in addition to Fe. Ti and B have an effect of achieving a finely-grained crystal of the Al alloy during casting. When the cast material having a fine crystal structure is used as a base material, the crystal grains are readily finely grained even though it is subjected to processing such as rolling and wire drawing or heat treatment including softening treatment after casting. As compared with the case of a coarse crystal structure, Al alloy wire 22 having a fine crystal structure is less likely to be broken upon an impact or repeated bending, thereby leading to excellent impact resistance and fatigue characteristics. The higher grain-refining effect is obtained in the order of: containing B alone, containing Ti alone and containing both Ti and B. In the case where Ti is included in a content equal to or more than 0% and equal to or less than 0.05% and further equal to or more than 0.005% and equal to or less than 0.05%, and in the case where B is included in a content equal to or more than 0% and equal to or less than 0.005% and further equal to or more than 0.001% and equal to or less than 0.005%, the crystal grain-refining effect can be achieved while the electrical conductivity reduction resulting from containing of Ti and B can be suppressed. In consideration of the balance between the crystal grain-refining effect and the electrical conductivity, the content of Ti can be set to be equal to or more than 0.01% and equal to or less than 0.04% and further equal to or less than 0.03% while the content of B can be set to be equal to or more than 0.002% and equal to or less than 0.004%.

A specific example of the composition containing the above-described elements in addition to Fe will be described below.

(1) Containing: equal to or more than 0.01% and equal to or less than 2.2% of Fe; and equal to or more than 0.05% and equal to or less than 0.5% of Mg, with a remainder of Al and an inevitable impurity.

(2) Containing: equal to or more than 0.01% and equal to or less than 2.2% of Fe; equal to or more than 0.05% and equal to or less than 0.5% of Mg; and equal to or more than 0.03% and equal to or less than 0.3% of Si, with a remainder of Al and an inevitable impurity.

(3) Containing: equal to or more than 0.01% and equal to or less than 2.2% of Fe; equal to or more than 0.05% and equal to or less than 0.5% of Mg; and equal to or more than 0.005% and equal to or less than 0.2% in total of one or more of elements selected from Mn, Ni, Zr, Ag, Cr, and Zn, with a remainder of Al and an inevitable impurity.

(4) Containing: equal to or more than 0.1% and equal to or less than 2.2% of Fe; and equal to or more than 0.05% and equal to or less than 0.5% of Cu, with a remainder of Al and an inevitable impurity.

(5) At least one of elements containing: equal to or more than 0.1% and equal to or less than 2.2% of Fe; equal to or more than 0.05% and equal to or less than 0.5% of Cu; equal to or more than 0.05% and equal to or less than 0.5% of Mg; and equal to or more than 0.03% and equal to or less than 0.3% of Si, with a remainder of Al and an inevitable impurity.

(6) In one of the above-mentioned (1) to (5), containing at least one of elements of: equal to or more than 0.005% and equal to or less than 0.05% of Ti; and equal to or more than 0.001% and equal to or less than 0.005% of B.

(Structure)

Voids

Figure 3:
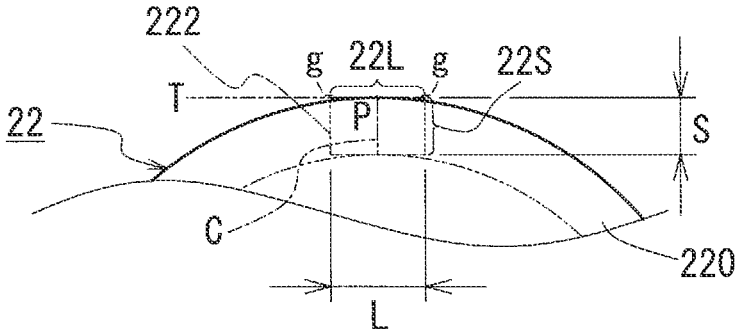
FIG. 3 is an explanatory diagram illustrating a method of measuring voids.

Al alloy wire 22 in the embodiment has a surface layer containing a small amount of voids. Specifically, in the transverse section of Al alloy wire 22, a surface layer region 220 extending from the surface of Al alloy wire 22 by 30 μm in the depth direction, that is, an annular region having a thickness of 30 μm, is defined as shown in FIG. 3. Then, within this surface layer region 220, a surface-layer void measurement region 222 (indicated by a dashed line in FIG. 3) in a shape of a rectangle having a short side length S of 30 μm and a long side length L of 50 μm is defined. Short side length S corresponds to the thickness of surface layer region 220. Specifically, a tangent line T to an arbitrary point (a contact point P) on the surface of Al alloy wire 22 is defined. A straight line C having a length of 30 μm is defined in the direction normal to the surface from contact point P toward the inside of Al alloy wire 22. When Al alloy wire 22 is a round wire, straight line C extending toward the center of this circle of the round wire is defined. The straight line extending in parallel to straight line C and having a length of 30 μm is defined as a short side 22S. The straight line extending through contact point P along tangent line T and having a length of 50 μm so as to define contact point P as an intermediate point is defined as a long side 22L. Occurrence of a minute cavity (a hatched portion) g not including Al alloy wire 22 in surface-layer void measurement region 222 is allowed. The total cross-sectional area of the voids existing in this surface-layer void measurement region 222 is equal to or less than 2 $\mu m^2$. When the surface layer contains a small amount of voids, cracking occurring from the voids as origins upon an impact or repeated bending is more likely to be suppressed, so that progress of cracking from the surface layer toward the inside thereof can also be suppressed. As a result, breakage resulting from voids can be suppressed. Thus, Al alloy wire 22 in the embodiment is excellent in impact resistance and fatigue characteristics. On the one hand, when the total area of voids is relatively large, coarse voids exist or a large amount of fine voids exist. Thus, voids become origins of cracking or cracking is more likely to progress, thereby leading to inferior impact resistance and fatigue characteristics. On the other hand, the smaller total cross-sectional area of voids leads to a smaller amount of voids, to reduce breakage resulting from voids, thereby leading to excellent impact resistance and fatigue characteristics. Thus, the total cross-sectional area of voids is preferably less than 1.5 $\mu m^2$, equal to or less than 1 $\mu m^2$, and further, equal to or less than 0.95 $\mu m^2$, and more preferably closer to zero. For example, when the temperature of melt is set to be relatively low in the casting process, the amount of voids is more likely to be reduced. In addition, acceleration of the cooling rate during casting, particularly the cooling rate in a specific temperature range described later, tends to lead to a smaller amount and smaller size of voids.

Figure 4:
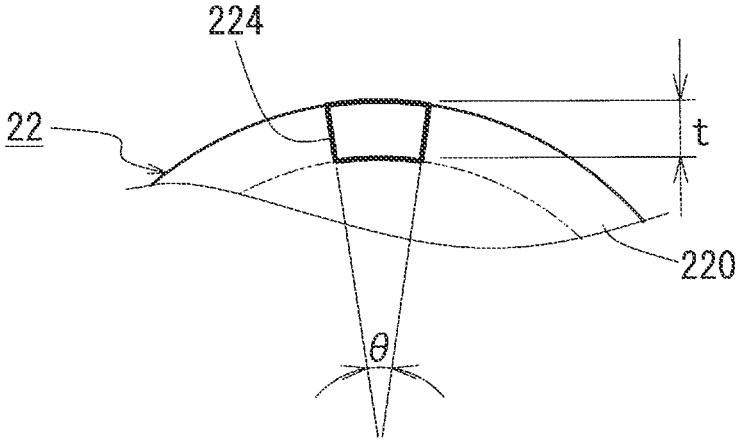
FIG. 4 is another explanatory diagram illustrating the method of measuring voids.

When Al alloy wire 22 is a round wire or when Al alloy wire 22 is substantially regarded as a round wire, the void measurement region in the above-mentioned surface layer can be formed in a sector shape as shown in FIG. 4. FIG. 4 shows a void measurement region 224 indicated by a bold line so as to be recognizable. As shown in FIG. 4, in the transverse section of Al alloy wire 22, surface layer region 220 extending from the surface of Al alloy wire 22 by 30 μm in the depth direction, that is, an annular region having a thickness t of 30 μm, is defined. From this surface layer region 220, a sector-shaped region (referred to as void measurement region 224) having an area of 1500 $\mu m^2$ is defined. When a central angle θ of the sector-shaped region having an area of 1500 $\mu m^2$ is calculated using the area of annular surface layer region 220 and the area of 1500 $\mu m^2$ in void measurement region 224, sector-shaped void measurement region 224 can be extracted from annular surface layer region 220. If the total cross-sectional area of the voids existing in this sector-shaped void measurement region 224 is equal to or less than 2 $\mu m^2$, Al alloy wire 22 that is excellent in impact resistance and fatigue characteristics can be achieved for the reasons as described above. When both the rectangular-shaped surface-layer void measurement region and the sector-shaped void measurement region are defined and when the total area of voids existing in each of these regions is equal to or less than 2 $\mu m^2$, it is expected that the reliability as a wire member excellent in impact resistance and fatigue characteristics can be enhanced.

As an example of Al alloy wire 22 in the embodiment, there may be an Al alloy wire in which the amount of voids is small not only in the surface layer but also inside thereof. Specifically, in the transverse section of Al alloy wire 22, a region in a shape of a rectangle having a short side length of 30 μm and a long side length of 50 μm (which will be referred to as an inside void measurement region) is defined. This inside void measurement region is defined such that the center of the rectangle coincides with the center of Al alloy wire 22. When Al alloy wire 22 is a shaped wire, the center of the inscribed circle is defined as the center of Al alloy wire 22 (the rest is the same as above). In at least one of the rectangular-shaped surface-layer void measurement region and the sector-shaped void measurement region, the ratio of a total cross-sectional area Sib of voids existing in the inside void measurement region to a total cross-sectional area Sfb of voids existing in the above-mentioned measurement region (Sib/Sfb) is equal to or more than 1.1 and equal to or less than 44. Generally, in the casting process, solidification progresses from the surface layer of metal toward the inside thereof. Accordingly, when the gas in the atmosphere dissolves in a melt, gas in the surface layer of metal is more likely to leak to the outside thereof, but gas inside the metal is more likely to be confined and remained therein. In the case of the wire member manufactured using such a cast material as a base material, it is considered that the amount of voids is more likely to be larger inside the metal than in the surface layer thereof. If total cross-sectional area Sfb of the voids in the surface layer is small as described above, the amount of voids existing inside the metal is also small in the embodiment in which the above-mentioned ratio Sib/Sfb is small. Accordingly, in the present embodiment, occurrence and progress of cracking occurring upon an impact or repeated bending are more likely to be reduced, so that breakage resulting from voids is suppressed, thereby leading to excellent impact resistance and fatigue characteristics. The smaller ratio Sib/Sfb leads to a smaller amount of inside voids, thereby leading to excellent impact resistance and fatigue characteristics. Thus, it is more preferable that the ratio Sib/Sfb is equal to or less than 40, equal to or less than 30, equal to or less than 20, and equal to or less than 15. It is considered that the above-mentioned ratio Sib/Sfb of equal to or more than 1.1 is suitable for mass production since it allows production of Al alloy wire 22 including a small amount of voids without having to set the temperature of melt to be excessively low. It is considered that mass production is facilitated when the above-mentioned ratio Sib/Sfb is about 1.3 to 6.0.

Crystal Grain Size

As an example of Al alloy wire 22 in the embodiment, there may be an Al alloy wire made of an Al alloy having an average crystal grain size equal to or less than 50 μm. Al alloy wire 22 having a fine crystal structure is more likely to undergo bending and the like, and is excellent in flexibility, so that this Al alloy wire 22 is less likely to be broken upon an impact or repeated bending. Also due to a smaller amount of voids in the surface layer, Al alloy wire 22 in the embodiment is excellent in impact resistance and fatigue characteristics. The smaller average crystal grain size allows easier bending or the like, thereby leading to excellent impact resistance and fatigue characteristics. Thus, it is preferable that the average crystal grain size is equal to or less than 45 μm, equal to or less than 40 μm, and equal to or less than 30 μm. Depending on the composition or the manufacturing conditions, the crystal grain size is more likely to be finely grained, for example, when it contains Ti and B as described above.

(Hydrogen Content)

As an Example of Al alloy wire 22 in the embodiment, there may be an Al alloy wire containing 4.0 ml/100 g or less of hydrogen. One factor of causing voids is considered as hydrogen as described above. When hydrogen content is 4.0 ml or less per 100 g in mass of Al alloy wire 22, this Al alloy wire 22 includes a small amount of voids, so that breakage resulting from voids can be suppressed as described above. It is considered that a smaller hydrogen content leads to a smaller amount of voids. Thus, the hydrogen content is preferably equal to or less than 3.8 ml/100 g, equal to or less than 3.6 ml/100 g, and equal to or less than 3 ml/100 g, and more preferably closer to zero. Hydrogen in Al alloy wire 22 is considered as a remnant of dissolved hydrogen that is produced by dissolution of water vapor in the atmosphere into a melt by casting in the atmosphere containing water vapor in air atmosphere or the like. Accordingly, the hydrogen content tends to be reduced, for example, when dissolution of the gas from atmosphere is reduced by setting the temperature of melt to be relatively low. Furthermore, the hydrogen content tends to be reduced when at least one of Cu and Si is contained.

(Surface Oxide Film)

As an example of Al alloy wire 22 in the embodiment, there may be an Al alloy wire 22 having a surface oxide film that has a thickness of equal to or more than 1 nm and equal to or less than 120 nm. When the heat treatment such as softening treatment is performed, an oxide film may exist on the surface of Al alloy wire 22. When the surface oxide film is as thin as 120 nm or less, it becomes possible to reduce the amount of the oxide that is interposed between conductor 2 and terminal portion 4 when terminal portion 4 (FIG. 2) is attached to the end portion of conductor 2 formed of Al alloy wire 22. When the amount of oxide as an electrical insulator interposed between conductor 2 and terminal portion 4 is small, an increase in connection resistance between conductor 2 and terminal portion 4 can be suppressed. On the other hand, when the surface oxide film is equal to or more than 1 nm, the corrosion resistance of Al alloy wire 22 is increased. As the film is thinner in the above-mentioned range, the above-mentioned connection resistance increase can be more reduced. As the film is thicker in the above-mentioned range, the corrosion resistance can be more enhanced. In consideration of the suppression of the connection resistance increase and the corrosion resistance, the surface oxide film can be formed to have a thickness equal to or more than 2 nm and equal to or less than 115 nm, further, equal to or more than 5 nm and equal to or less than 110 nm, and still further equal to or less than 100 nm. The thickness of the surface oxide film can be adjusted, for example, by the heat treatment conditions. For example, the higher oxygen concentration in an atmosphere (for example, air atmosphere) is more likely to increase the thickness of the surface oxide film. The lower oxygen concentration (for example, inactive gas atmosphere, reducing gas atmosphere, and the like) is more likely to reduce the thickness of the surface oxide film.

(Characteristics)

Work Hardening Exponent

As an example of Al alloy wire 22 in the embodiment, there may be an Al alloy wire having a work hardening exponent equal to or more than 0.05. When the work hardening exponents is as high as 0.05 or more, Al alloy wire 22 is readily work-hardened in the case where plastic working is performed, for example, in which a strand wire formed by stranding a plurality of Al alloy wires 22 together is compression-molded into a compressed strand wire, and in which terminal portion 4 is pressure-bonded to the end portion of conductor 2 (which may be any one of a solid wire, a strand wire and a compressed strand wire) formed of Al alloy wires 22. Even when the cross-sectional area is decreased by plastic working such as compression molding and pressure bonding, strength is increased by work hardening and terminal portion 4 can be firmly fixed to conductor 2. Thus, Al alloy wire 22 having a large work hardening exponent allows formation of conductor 2 that is excellent in performance of fixation to terminal portion 4. It is preferable that the work hardening exponent is equal to or more than 0.08 and further equal to or more than 0.1 since the larger work hardening exponent can be expected to more improve the strength by work hardening. The work hardening exponent is more likely to be increased as the breaking elongation is larger. Thus, in order to increase the work hardening exponent, for example, the breaking elongation may be increased by adjusting the type, the content, the heat treatment conditions and the like of additive elements. In the case of Al alloy wire 22 having a specific structure in which a crystallized material (described later) is finely grained and the average crystal grain size falls within the above-mentioned specific range, the work hardening exponent is more likely to be equal to or more than 0.05. Thus, the work hardening exponent can be adjusted also by adjusting the type, the content, the heat treatment conditions and the like of additive elements using the structure of the Al alloy as an index.

Mechanical Characteristics and Electrical Characteristics

Al alloy wire 22 in the embodiment is formed of an Al alloy having the above-mentioned specific composition, and representatively subjected to heat treatment such as softening treatment, thereby leading to high tensile strength, high 0.2% proof stress, excellent strength, high breaking elongation, excellent toughness, high electrical conductivity, and also excellent electrical conductive property. Quantitatively, Al alloy wire 22 is assumed to satisfy one or more selected from the characteristics including: tensile strength equal to or more than 110 MPa and equal to or less than 200 MPa; 0.2% proof stress equal to or more than 40 MPa; breaking elongation equal to or more than 10%; and electrical conductivity equal to or more than 55% IACS. Al alloy wire 22 satisfying two characteristics, three characteristics and particularly all four characteristics among the above-mentioned characteristics is preferable since such Al alloy wire 22 is excellent in mechanical characteristics, more excellent in impact resistance and fatigue characteristics, excellent in impact resistance and fatigue characteristics, and excellent also in electrical conductive property. Such Al alloy wire 22 can be suitably utilized as a conductor of an electrical wire.

The higher tensile strength in the above-mentioned range leads to more excellent strength and more excellent fatigue characteristics. The lower tensile strength in the above-mentioned range is more likely to increase the breaking elongation and the electrical conductivity. In view of the above, the above-mentioned tensile strength can be set to be equal to or more than 110 MPa and equal to or less than 180 MPa, and further, equal to or more than 115 MPa and equal to or less than 150 MPa.

The breaking elongation equal to or more than 10% leads to excellent flexibility, excellent toughness and excellent impact resistance. The higher breaking elongation in the above-mentioned range leads to more excellent flexibility and toughness, thereby allowing easy bending and the like. Thus, the above-mentioned breaking elongation can be set to be equal to or more than 13%, equal to or more than 15%, and further, equal to or more than 20%.

Al alloy wire 22 is representatively utilized for conductor 2. Al alloy wire 22 having electrical conductivity equal to or more than 55% IACS is excellent in electrical conductive property, so that it can be suitably utilized for conductors of various types of electrical wires. It is more preferable that the electrical conductivity is equal to or more than 56% IACS, equal to or more than 57% IACS, and further, equal to or more than 58% IACS.

It is preferable that Al alloy wire 22 also has high 0.2% proof stress. This is because, in the case of the same tensile strength, the higher 0.2% proof stress is more likely to lead to excellent performance of fixation to terminal portion 4. When the 0.2% proof stress is equal to or more than 40 MPa, Al alloy wire 22 is more excellent in performance of fixation to the terminal portion particularly when the terminal portion is attached by pressure-bonding or the like. The 0.2 proof stress can be set to be equal to or more than 45 MPa, equal to or more than 50 MPa, and further, equal to or more than 55 MPa.

When the ratio of the 0.2% proof stress to the tensile strength is equal to or more than 0.4, Al alloy wire 22 exhibits sufficiently high 0.2% proof stress, has high strength, is less likely to be broken, and also has excellent performance of fixation to terminal portion 4, as described above. It is preferable that this ratio is equal to or more than 0.42 and also equal to or more than 0.45 since the higher ratio leads to higher strength and more excellent performance of fixation to terminal portion 4.

The tensile strength, the 0.2% proof stress, the breaking elongation, and the electrical conductivity can be changed, for example, by adjusting the type, the content, the manufacturing conditions (wire-drawing conditions, heat treatment conditions and the like) of additive elements. For example, larger amounts of additive elements tend to lead to higher tensile strength and higher 0.2% proof stress. Smaller amounts of additive elements tend to lead to higher electrical conductivity. Also, a higher heating temperature during the heat treatment tends to lead to higher breaking elongation.

(Shape)

The shape of the transverse section of Al alloy wire 22 in the embodiment can be selected as appropriate depending on an intended use and the like. For example, there may be a round wire having a transverse section of a circular shape (see FIG. 1). In addition, there may be a rectangular wire or the like having a transverse section of a quadrangular shape such as a rectangular shape. When Al alloy wire 22 forms an elemental wire of the above-mentioned compressed strand wire, it representatively has a deformed shape having a crushed circle. As the above-mentioned measurement region for evaluating voids, a rectangular region is easily utilized when Al alloy wire 22 is a rectangular wire and the like, and a rectangular region or a sector-shaped region may be utilized when Al alloy wire 22 is a round wire or the like. The shape of the wire-drawing die, the shape of the die for compression molding, and the like may be selected such that the shape of the transverse section of Al alloy wire 22 is formed in a desired shape.

(Dimensions)

The dimensions (the transverse sectional area, the wire diameter (diameter) in the case of a round wire, and the like) of Al alloy wire 22 in the embodiment can be selected as appropriate depending on an intended use and the like. For example, when Al alloy wire 22 is used for a conductor of an electrical wire provided in various kinds of wire harnesses such as a wire harness for an automobile, the wire diameter of Al alloy wire 22 may be equal to or more than 0.2 mm and equal to or less than 1.5 mm. For example, when Al alloy wire 22 is used for a conductor of an electrical wire for constructing the interconnection structure of a building and the like, the wire diameter of Al alloy wire 22 may be equal to or more than 0.2 mm and equal to or less than 3.6 mm.

[Al Alloy Strand Wire]

Al alloy wire 22 in the embodiment can be utilized for an elemental wire of a strand wire, as shown in FIG. 1. Al alloy strand wire 20 in the embodiment is formed by stranding a plurality of Al alloy wires 22 together. Al alloy strand wire 20 is formed by stranding a plurality of elemental wires (Al alloy wires 22) each having a cross-sectional area smaller than that of the Al alloy wire as a solid wire having the same conductor cross-sectional area, thereby leading to excellent flexibility and allowing easy bending and the like. Furthermore, since the wires are stranded together, the strand wire is entirely excellent in strength even though Al alloy wire 22 as each elemental wire is relatively thin. Furthermore, Al alloy strand wire 20 in the embodiment is formed using, as an elemental wire, Al alloy wire 22 having a specific structure including a small amount of voids. In view of the above, even when Al alloy strand wire 20 undergoes an impact or repeated bending, Al alloy wire 22 as each elemental wire is less likely to be broken, thereby leading to excellent impact resistance and fatigue characteristics. When the characteristics such as the hydrogen content, the crystal grain size as described above fall within the above-mentioned specific ranges, Al alloy wire 22 as each elemental wire is further excellent in impact resistance and fatigue characteristics.

The number of stranding wires for Al alloy strand wire 20 can be selected as appropriate, and may be 7, 11, 16, 19, 37, and the like, for example. The strand pitch of Al alloy strand wire 20 can be selected as appropriate. In this case, when the strand pitch is set to be equal to or more than 10 times as large as the pitch diameter of Al alloy strand wire 20, the wires are less likely to be separated when terminal portion 4 is attached to the end portion of conductor 2 formed of Al alloy strand wire 20, so that terminal portion 4 can be attached in an excellent workability. On the other hand, when the strand pitch is set to be equal to or less than 40 times as large as the above-mentioned pitch diameter, the elemental wires are less likely to be twisted upon bending or the like, so that breakage is less likely to occur, thereby leading to excellent fatigue characteristics. In consideration of preventing separation and twisting of wires, the strand pitch can be set to be equal to or more than 15 times and equal to or less than 35 times as large as the above-mentioned pitch diameter, and also, equal to or more than 20 times and equal to or less than 30 times as large as the above-mentioned pitch diameter.

Al alloy strand wire 20 can be formed as a compressed strand wire that has been further subjected to compression-molding. In this case, the wire diameter can be reduced more than that in the state where the wires are simply stranded together, or the outer shape can be formed in a desired shape (for example, a circle). When the work hardening exponent of Al alloy wire 22 as each elemental wire is relatively high as described above, the strength, the impact resistance and the fatigue characteristics can also be expected to be improved.

The specifications of each Al alloy wire 22 forming Al alloy strand wire 20 such as the composition, the structure, the surface oxide film thickness, the hydrogen content, the mechanical characteristics, and the electrical characteristics are substantially maintained at the specifications of Al alloy wire 22 used before wire stranding. By performing heat treatment after wire stranding, the thickness of the surface oxide film, the mechanical characteristics, and the electrical characteristics may be changed. The stranding conditions may be adjusted such that the specifications of Al alloy strand wire 20 achieve desired values.

[Covered Electrical Wire]

Al alloy wire 22 in the embodiment and Al alloy strand wire 20 (which may be a compressed strand wire) in the embodiment can be suitably utilized for a conductor for an electrical wire, and also can be utilized for each of a bare conductor having no insulation cover and a conductor of a covered electrical wire having an insulation cover. Covered electrical wire 1 in the embodiment includes conductor 2 and insulation cover 3 that covers the outer circumference of conductor 2, and also includes, as conductor 2, Al alloy wire 22 in the embodiment or Al alloy strand wire 20 in the embodiment. This covered electrical wire 1 includes conductor 2 formed of Al alloy wire 22 and Al alloy strand wire 20 each of which is excellent in impact resistance and fatigue characteristics, thereby leading to excellent impact resistance and fatigue characteristics. The insulating material forming insulation cover 3 can be selected as appropriate. Examples of the above-mentioned insulating material may be materials excellent in flame resistance such as polyvinyl chloride (PVC), non-halogen resin, and the like, which can be known materials. The thickness of insulation cover 3 can be selected as appropriate in a range exhibiting prescribed insulation strength.

[Terminal-Equipped Electrical Wire]

Figure 2:
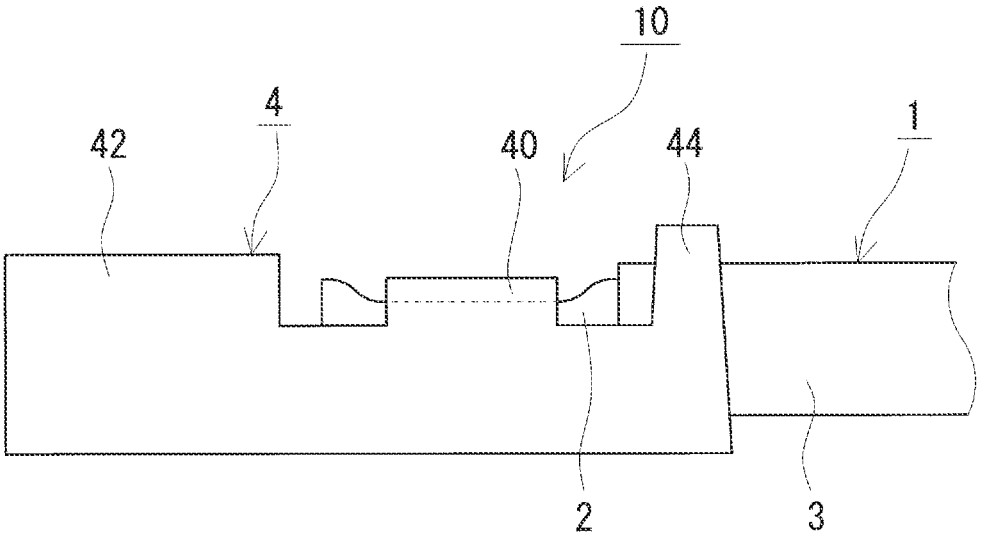
FIG. 2 is a schematic side view showing the vicinity of a terminal portion of a terminal-equipped electrical wire in an embodiment.

Covered electrical wire 1 in the embodiment can be utilized for electrical wires for various uses such as wire harnesses placed in devices in an automobile, an airplane and the like, interconnections in various kinds of electrical devices such as an industrial robot, interconnections in a building, and the like. When covered electrical wire 1 is provided in a wire harness or the like, representatively, terminal portion 4 is attached to the end portion of covered electrical wire 1. Terminal-equipped electrical wire 10 in the embodiment includes covered electrical wire 1 in the embodiment and terminal portion 4 attached to the end portion of covered electrical wire 1, as shown in FIG. 2. Since this terminal-equipped electrical wire 10 includes covered electrical wire 1 that is excellent in impact resistance and fatigue characteristics, it is also excellent in impact resistance and fatigue characteristics. FIG. 2 shows an example of a crimp terminal as terminal portion 4 having: one end including a female-type or male-type fitting portion 42; the other end including an insulation barrel portion 44 for gripping insulation cover 3; and an intermediate portion including a wire barrel portion 40 for gripping conductor 2. Another example of terminal portion 4 may be a melting-type terminal portion for melting conductor 2 for connection.

The crimp terminal is pressure-bonded to the end portion of conductor 2 exposed by removing insulation cover 3 at the end portion of covered electrical wire 1, and is electrically and mechanically connected to conductor 2. When Al alloy wire 22 and Al alloy strand wire 20 forming conductor 2 are relatively high in work hardening exponent as described above, the portion of conductor 2 to which the crimp terminal is attached has a cross-sectional area that is locally reduced, but has excellent strength due to work hardening. Thus, for example, even upon an impact during connection between terminal portion 4 and the connection subject of covered electrical wire 1, and even upon repeated bending after connection, breakage of conductor 2 in the vicinity of terminal portion 4 can be suppressed. Thus, this terminal-equipped electrical wire 10 is excellent in impact resistance and fatigue characteristics.

In Al alloy wire 22 and Al alloy strand wire 20 forming conductor 2, when the surface oxide film is formed to be thin as described above, an electrical insulator (an oxide and the like forming a surface oxide film) interposed between conductor 2 and terminal portion 4 can be reduced, so that the connection resistance between conductor 2 and terminal portion 4 can be reduced. Accordingly, this terminal-equipped electrical wire 10 is excellent in impact resistance and fatigue characteristics, and also has a small connection resistance.

Terminal-equipped electrical wire 10 may be configured such that one terminal portion 4 is attached to each covered electrical wire 1 as shown in FIG. 2, and also may be configured such that one terminal portion (not shown) is provided in a plurality of covered electrical wires 1. When a plurality of covered electrical wires 1 are bundled with a bundling tool or the like, terminal-equipped electrical wire 10 can be easily handled.

[Method of Manufacturing Al Alloy Wire and Method of Manufacturing Al Alloy Strand Wire]

SUMMARY

Al alloy wire 22 in the embodiment can be representatively manufactured by performing heat treatment (including softening treatment) at an appropriate timing in addition to the basic step such as casting, (hot) rolling, extrusion, and wire drawing. Known conditions and the like can be applied as the conditions of the basic step, the softening treatment, and the like. Al alloy strand wire 20 in the embodiment can be manufactured by stranding a plurality of Al alloy wires 22 together. Known conditions can be applied as the stranding conditions and the like.

(Casting Step)

Particularly, Al alloy wire 22 in the embodiment including a surface layer containing a small amount of voids can be readily manufactured, for example, when the temperature of melt is set to be relatively low in the casting process. Thereby, dissolution of gas in the atmosphere into a melt can be reduced, so that a cast material can be manufactured with a melt containing a small amount of dissolved gas. Examples of dissolved gas may be hydrogen as described above. This hydrogen is considered as a decomposition of water vapor in the atmosphere, and considered to be contained in the atmosphere. When a cast material with a small amount of dissolved gas such as dissolved hydrogen is used as a base material, it becomes possible to readily maintain the state where the Al alloy contains a small amount of voids, which result from dissolved gas, at and after casting despite plastic working such as rolling and wire drawing or heat treatment such as softening treatment. As a result, the voids existing in the surface layer and the inside of Al alloy wire 22 having a final wire diameter can be set to fall within the above-described specific range. Furthermore, Al alloy wire 22 containing a small amount of hydrogen as described above can be manufactured. It is considered that the positions of voids confined inside the Al alloy are changed and the sizes of voids are reduced to some extent by performing treatment (rolling, extrusion, wire drawing and the like) involving the steps subsequent to the casting process, for example, stripping and plastic deformation. However, it is considered that, when the total content of voids existing in the cast material is relatively large, the total content of voids and the hydrogen content existing in the surface layer and inside of the Al alloy wire having a final wire diameter are more likely to be increased (substantially remained maintained), even if the positions and the sizes of the voids are changed. Accordingly, it is proposed to lower the temperature of melt to sufficiently reduce the voids contained in the cast material itself.

Examples of specific temperature of melt may be equal to or more than the liquidus temperature and less than 750° C. in the Al alloy. It is preferable that the temperature of melt is equal to or less than 748° C., and also, equal to or less than 745° C. since the lower temperature of melt can further reduce dissolved gas and further reduce the voids in the cast material. On the other hand, when the temperature of melt is high to some extent, additive elements are readily dissolved. Accordingly, the temperature of melt can be set to be equal to or more than 670° C., and also, equal to or more than 675° C. Thus, an Al alloy wire excellent in strength, toughness and the like is readily achieved. By lowering the temperature of melt in this way, even when casting is performed in the atmosphere containing water vapor such as air atmosphere, dissolved gas can be reduced, with the result that the total content of voids and the content of hydrogen that result from the dissolved gas can be reduced.

In addition to lowering of the temperature of melt, the cooling rate in the casting process (particularly the cooling rate in the specific temperature range from the temperature of melt to 650° C.) is accelerated to some extent, so that dissolved gas from the atmosphere can be readily prevented from increasing. This is because the above-mentioned specific temperature range is mainly a liquid phase range, in which hydrogen or the like is readily dissolved and dissolved gas is readily increased. On the other hand, it is considered that the cooling rate in the above-mentioned specific temperature range is not excessively accelerated, so that the dissolved gas inside the metal in the middle of solidification is readily discharged to the atmosphere. In consideration of suppressing an increase in dissolved gas, it is preferable that the above-mentioned cooling rate is equal to or more than 1° C./second, and equal to or more than 2° C./second, and further, equal to or more than 4° C./second. In consideration of accelerating discharge of the dissolved gas inside the metal as described above, the above-mentioned cooling rate can be set to be equal to or less than 30° C./second, less than 25° C./second, equal to or less than 20° C./second, less than 20° C./second, equal to or less than 15° C./second, and equal to or less than 10° C./second. When the cooling rate is not excessively high, it is also suitable for mass production.

It has been found that, when the cooling rate in the specific temperature range in the casting process is accelerated to some extent as described above, Al alloy wire 22 containing a certain amount of fine crystallized material can be manufactured. In this case, the above-mentioned specific temperature range is mainly a liquid phase range as described above. Thus, when the cooling rate in the liquid phase range is raised, the crystallized material produced during solidification is more likely to be reduced in size. However, it is considered that, when the cooling rate is too high in the case where the temperature of melt is lowered as described above, particularly when the cooling rate is equal to or more than 25° C./second, the crystallized material is less likely to be produced, so that the dissolution amount of additive element is increased to thereby lower the electrical conductivity, and so that the pinning effect of crystal grains by the crystallized material is less likely to be achieved. In contrast, when the temperature of melt is set to be relatively low as described above and the cooling rate in the above-mentioned temperature range is accelerated to some extent, a coarse crystallized material is less likely to be contained while a certain amount of fine crystallized materials having a relatively uniform size is more likely to be contained. Eventually, Al alloy wire 22 having a surface layer with a small amount of voids and containing a certain amount of fine crystallized materials can be manufactured. In consideration of achieving a finer crystallized material, it is preferable that the cooling rate is more than 1° C./second, and also, equal to or more than 2° C./second, depending on the content of additive elements such as Fe.

In view of the above, it is preferable that the temperature of melt is set to be equal to or more than 670° C. and less than 750° C. and the cooling rate from the temperature of melt to 650° C. is set to be less than 20° C./second.

Furthermore, when the cooling rate in the casting process is accelerated in the above-described range, it is expectable to achieve such effects as that: a cast material having a fine crystal structure is readily achieved; additive elements are readily dissolved to some extent; and the dendrite arm spacing (DAS) is readily reduced (for example, to be equal to or less than 50 μm, and also equal to or less than 40 μm).

Both continuous casting and metal mold casting (billet casting) can be utilized for casting. Continuous casting allows continuous production of an elongated cast material and also facilitates acceleration of the cooling rate. Thus, it is expectable to achieve effects of: reducing voids; suppressing a coarse crystallized material; forming a finer crystal grain and a finer DAS; dissolving an additive element; and the like, as described above.

(Step to Wire Drawing)

An intermediate working material obtained representatively by subjecting a cast material to plastic working (intermediate working) such as (hot) rolling and extrusion is subjected to wire drawing. Also, by performing hot rolling subsequent to continuous casting, a continuous cast and rolled material (an example of the intermediate working material) can also be subjected to wire drawing. Stripping and heat treatment can be performed before and after the above-mentioned plastic working. By stripping, the surface layer that may include voids, a surface flaw and the like can be removed. The heat treatment performed in this case may be performed, for example, for the purpose of achieving homogenization of an Al alloy, or the like. The conditions of homogenization treatment may be set such that the heating temperature is equal to or more than about 450° C. and equal to or less than about 600° C., and the retention time is equal to or longer than about 0.5 hours and equal to or shorter than about 5 hours. When the homogenization treatment is performed under these conditions, a crystallized material that is uneven and coarse due to segregation is readily finely grained and uniformly sized to some extent. It is preferable to perform homogenization treatment after casting when a billet cast material is used.

(Wire Drawing Step)

The base material (intermediate working material) having been subjected to plastic working such as the above-mentioned rolling is subjected to (cold) wire drawing until a prescribed final wire diameter is achieved, thereby forming a wire-drawn member. The wire drawing is representatively performed using a wire-drawing die. The wire-drawing degree may be selected as appropriate in accordance with the final wire diameter.

(Stranding Step)

For manufacturing Al alloy strand wire 20, a plurality of wire members (wire-drawn members or heat treated members subjected to heat treatment after wire drawing) are prepared and stranded together in a prescribed strand pitch (for example, 10 times to 40 times as high as the pitch diameter). For forming Al alloy strand wire 20 as a compressed strand wire, wire members are stranded and thereafter compression-molded into a prescribed shape.

(Heat Treatment)

Heat treatment can be performed for the wire-drawn member at an appropriate timing during and after wire drawing. Particularly when softening treatment for the purpose of improving toughness such as breaking elongation is performed, Al alloy wire 22 and Al alloy strand wire 20 having high strength and high toughness and also having excellent impact resistance and excellent fatigue characteristics can be manufactured. The heat treatment may be performed at least one of timings including: during wire drawing; after wire drawing (before wire stranding); after wire stranding (before compression molding); and after compression molding. Heat treatment may be performed at a plurality of timings. Heat treatment may be performed by adjusting the heat treatment conditions such that Al alloy wire 22 and Al alloy strand wire 20 as end products satisfy desired characteristics, for example, such that the breaking elongation becomes equal to or more than 10%. By performing heat treatment (softening treatment) such that breaking elongation becomes equal to or more than 10%, Al alloy wire 22 having a work hardening exponent falling within the above-mentioned specific range can also be manufactured. When heat treatment is performed in the middle of wire drawing or before wire stranding, workability is enhanced, so that wire drawing, wire stranding and the like can be readily performed.

Heat treatment can be utilized in each of: continuous treatment in which a subject to be heat-treated is continuously supplied into a heating container such as a pipe furnace or an electricity furnace; and batch treatment in which a subject to be heat-treated is heated in the state where the subject is enclosed in a heating container such as an atmosphere furnace. The batch treatment conditions may be set, for example, such that the heating temperature is equal to or more than about 250° C. and equal to or less than about 500° C., and the retention time is equal to or longer than about 0.5 hours and equal to or shorter than about 6 hours. In the continuous treatment, the control parameter may be adjusted such that the wire member after heat treatment satisfies desired characteristics. The continuous treatment conditions are readily adjusted when the correlation data between the characteristics and the parameter values are prepared in advance so as to satisfy desired characteristics in accordance with the dimensions (a wire diameter, a cross-sectional area and the like) of the subject to be heat-treated (see PTL 1).

Examples of the atmosphere during heat treatment may be: an atmosphere such as an air atmosphere containing a relatively large amount of oxygen; or a low-oxygen atmosphere containing oxygen less than that in atmospheric air. In the case of an air atmosphere, the atmosphere does not have to be controlled, but a surface oxide film is more likely to be formed thicker (for example, equal to or more than 50 nm). Thus, in the case of an air atmosphere, by employing continuous treatment facilitating a shorter retention time, Al alloy wire 22 including a surface oxide film having a thickness falling within the above-mentioned specific range is readily manufactured. Examples of low-hydrogen atmosphere may be a vacuum atmosphere (a decompressed atmosphere), an inactive gas atmosphere, a reducing gas atmosphere, and the like. Examples of inert gas may be nitrogen, argon, and the like. Examples of reducing gas may be hydrogen gas, hydrogen mixed gas containing hydrogen and inert gas, mixed gas of carbon monoxide and carbon dioxide, and the like. In a low-oxygen atmosphere, the atmosphere has to be controlled, but the surface oxide film is more likely to be formed thinner (for example, less than 50 nm). Accordingly, in the case of a low-oxygen atmosphere, by employing batch treatment allowing easy atmosphere control, it becomes possible to readily manufacture Al alloy wire 22 including a surface oxide film having a thickness falling within the above-mentioned specific range and preferably Al alloy wire 22 including a thinner surface oxide film.

When the composition of the Al alloy is adjusted as described above (preferably, both Ti and B are added) and a continuous cast material or a continuous cast and rolled material is used as a base material, Al alloy wire 22 exhibiting a crystal grain size falling within the above-mentioned range is readily manufactured. Particularly when the wire-drawn member having a final wire diameter, the strand wire or the compressed strand wire is subjected to heat treatment (softening treatment) such that the breaking elongation becomes equal to or more than 10% while setting the wire drawing degree to be 80% or more at which the base material obtained by subjecting a continuous cast material to plastic working such as rolling or the continuous cast and rolled material is processed and formed into an wire-drawn member having a final wire diameter, Al alloy wire 22 having a crystal grain size equal to or less than 50 μm is further readily manufactured. In this case, heat treatment may also be performed in the middle of wire drawing. By controlling a crystal structure and also controlling breaking elongation in this way, Al alloy wire 22 exhibiting a work hardening exponent falling within the above-mentioned specific range can also be manufactured.

(Other Steps)

In addition, examples of the method of adjusting the thickness of a surface oxide film may be: exposing the wire-drawn member having a final wire diameter under the existence of hot water of high temperature and high pressure; applying water to the wire-drawn member having a final wire diameter; providing a drying step after water-cooling when water-cooling is performed after heat treatment in the continuous treatment in an air atmosphere; and the like. The surface oxide film tends to be increased in thickness by exposure to hot water and application of water. By drying after water-cooling as described above, formation of a boehmite layer resulting from water-cooling is prevented, so that a surface oxide film tends to be formed thinner.

[Method of Manufacturing Covered Electrical Wire]

Covered electrical wire 1 in the embodiment can be manufactured by preparing Al alloy wire 22 or Al alloy strand wire 20 (which may be a compressed strand wire) of the embodiment that forms conductor 2, and forming insulation cover 3 on the outer circumference of conductor 2 by extrusion or the like. Known conditions can be applied as the extrusion conditions and the like.

[Method of Manufacturing Terminal-Equipped Electrical Wire]

Terminal-equipped electrical wire 10 in the embodiment can be manufactured by removing insulation cover 3 from the end portion of covered electrical wire 1 so as to expose conductor 2 to which terminal portion 4 is attached.

Test Example 1

Al alloy wires were produced under various conditions to examine the characteristics thereof. Also, these Al alloy wires were used to produce an Al alloy strand wire, and further, a covered electrical wire including this Al alloy strand wire as a conductor was produced. Then, a crimp terminal was attached to an end portion of the covered electrical wire, to thereby obtain a terminal-equipped covered electrical wire. The characteristics of the terminal-equipped covered electrical wire were examined.

The Al alloy wire is produced as follows.

Pure aluminum (99.7 mass % or more of Al) was prepared as a base material and dissolved to obtain a melt (molten aluminum), into which additive elements shown in Tables 1 to 4 were added in content (mass %) as shown in Tables 1 to 4, thereby producing a melt of an Al alloy. When the melt of the Al alloy having been subjected to component adjustment is subjected to hydrogen-gas removing treatment and foreign-sub stance removing treatment, the hydrogen content can be readily reduced and foreign substances can be readily reduced.

The prepared melt of the Al alloy is used to produce a continuous cast and rolled material or a billet cast material. The continuous cast and rolled material is produced by continuously performing casting and hot rolling using a belt wheel-type continuous casting rolling machine and the prepared melt of Al alloy, thereby forming a wire rod of ϕ 9.5 mm. The melt of Al alloy is poured into a prescribed fixed mold and then cooled to thereby produce a billet cast material. The billet cast material is homogenized and thereafter subjected to hot-rolling to thereby produce a wire rod (rolled material) of ϕ 9.5 mm. Tables 5 to 8 shows the types of the casting method (a continuous cast and rolled material is indicated as "continuous" and a billet cast material is indicated as "billet"), the temperature of melt (° C.), and the cooling rate in the casting process (the average cooling rate from the temperature of melt to 650° C.; ° C./second). The cooling rate was changed by adjusting the cooling state using a water-cooling mechanism or the like.

The above-mentioned wire rod is subjected to cold wire-drawing to produce a wire-drawn member having a wire diameter of ϕ 0.3 mm, a wire-drawn member having a wire diameter of ϕ 0.37 mm, and a wire-drawn member having a wire diameter of ϕ 0.39 mm.

The obtained wire-drawn member having a wire diameter of ϕ 0.3 mm is subjected to softening treatment by the method, at the temperature (° C.) and in the atmosphere shown in Tables 5 to 8 to thereby produce a softened member (an Al alloy wire). The "bright softening" indicated as a method in Tables 5 to 8 is batch treatment using a box-type furnace, in which the retention time is set at three hours. The "continuous softening" indicated as a method in Tables 5 to 8 is continuous treatment in a high-frequency induction heating scheme or a direct energizing scheme, in which the energizing conditions are controlled so as to achieve the temperatures (measured by an contactless infrared thermometer) shown in Tables 5 to 8. The linear velocity is selected from the range of 50 m/min to 3,000 m/min. Sample No. 2-202 is not subjected to softening treatment. Sample No. 2-203 is treated under heat treatment conditions, such as 550° C.×8 hours, that are higher in temperature and longer in time period than other samples ("*1" is added to the column of temperature in Table 8). Sample No. 2-205 is subjected to boehmite treatment (100° C.×15 minutes) after softening treatment in an air atmosphere ("*2" is added to the column of atmosphere in Table 8).

TABLE 1

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 1-1 | 0.1 | — | — | — | — | — | — | — | — | — | 0 | 0 | 0.01 | 0.002 |
| 1-2 | 0.2 | — | — | — | — | — | — | — | — | — | 0 | 0 | 0.02 | 0.004 |
| 1-3 | 0.6 | — | — | — | — | — | — | — | — | — | 0 | 0 | 0.02 | 0.004 |
| 1-4 | 1 | — | — | — | — | — | — | — | — | — | 0 | 0 | 0.03 | 0.005 |
| 1-5 | 1 | — | — | — | — | — | — | — | — | — | 0 | 0 | 0.03 | 0.015 |
| 1-6 | 1.7 | — | — | — | — | — | — | — | — | — | 0 | 0 | 0.02 | 0.004 |
| 1-7 | 2 | — | — | — | — | — | — | — | — | — | 0 | 0 | 0 | 0 |
| 1-8 | 2.2 | — | — | — | — | — | — | — | — | — | 0 | 0 | 0.02 | 0.004 |
| 1-9 | 0.5 | — | 0.03 | — | — | — | — | — | — | — | 0 | 0.03 | 0.01 | 0.002 |
| 1-10 | 0.5 | — | 0.25 | — | — | — | — | — | — | — | 0 | 0.25 | 0.01 | 0.002 |
| 1-11 | 0.5 | — | — | — | 0.005 | — | — | — | — | — | 0.005 | 0.005 | 0.01 | 0 |
| 1-12 | 0.5 | — | — | — | 0.08 | — | — | — | — | — | 0.08 | 0.08 | 0.02 | 0.004 |
| 1-13 | 0.5 | — | — | — | — | 0.005 | — | — | — | — | 0.005 | 0.005 | 0.02 | 0 |
| 1-14 | 0.5 | — | — | — | — | 0.1 | — | — | — | — | 0.1 | 0.1 | 0.02 | 0.004 |
| 1-15 | 0.5 | — | — | — | — | — | 0.005 | — | — | — | 0.005 | 0.005 | 0 | 0 |
| 1-16 | 0.5 | — | — | — | — | — | 0.1 | — | — | — | 0.1 | 0.1 | 0.02 | 0.004 |
| 1-17 | 1 | — | — | — | — | — | — | 0.005 | — | — | 0.005 | 0.005 | 0.02 | 0.004 |
| 1-18 | 1 | — | — | — | — | — | — | 0.02 | — | — | 0.02 | 0.02 | 0.01 | 0.002 |
| 1-19 | 1 | — | — | — | — | — | — | — | 0.005 | — | 0.005 | 0.005 | 0.01 | 0.002 |
| 1-20 | 1 | — | — | — | — | — | — | — | 0.03 | — | 0.03 | 0.03 | 0 | 0 |
| 1-21 | 1 | — | — | — | — | — | — | — | — | 0.005 | 0.005 | 0.005 | 0.01 | 0.002 |
| 1-22 | 1 | — | — | — | — | — | — | — | — | 0.07 | 0.07 | 0.07 | 0.02 | 0.004 |
| 1-23 | 1.5 | — | 0.03 | — | — | — | 0.02 | — | — | — | 0.02 | 0.05 | 0.008 | 0.002 |
| 1-101 | 0.001 | — | — | — | — | — | — | — | — | — | 0 | 0 | 0.02 | 0.004 |
| 1-102 | 0.001 | — | — | — | — | — | — | — | — | — | 0 | 0 | 0.02 | 0.004 |
| 1-103 | 2.5 | — | — | — | — | 0.5 | — | — | — | — | 0.5 | 0.5 | 0.01 | 0.002 |
| 1-104 | 2.5 | — | — | — | — | 0.5 | — | — | — | — | 0.5 | 0.5 | 0.01 | 0.002 |

TABLE 2

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 2-1 | 0.01 | 0.5 | — | — | — | — | — | — | — | — | 0 | 0.5 | 0.05 | 0.005 |
| 2-2 | 0.2 | 0.15 | — | — | — | — | — | — | — | — | 0 | 0.15 | 0 | 0 |
| 2-3 | 0.6 | 0.3 | — | — | — | — | — | — | — | — | 0 | 0.3 | 0 | 0 |
| 2-4 | 0.9 | 0.05 | — | — | — | — | — | — | — | — | 0 | 0.05 | 0.03 | 0.005 |
| 2-5 | 1 | 0.2 | — | — | — | — | — | — | — | — | 0 | 0.2 | 0.02 | 0.004 |
| 2-6 | 1.05 | 0.15 | — | — | — | — | — | — | — | — | — | 0.15 | 0.03 | 0.002 |
| 2-7 | 1.5 | 0.15 | — | — | — | — | — | — | — | — | 0 | 0.15 | 0.02 | 0.004 |
| 2-8 | 2.2 | 0.25 | — | — | — | — | — | — | — | — | 0 | 0.25 | 0.01 | 0 |
| 2-9 | 1 | 0.2 | 0.04 | — | — | — | — | — | — | — | 0 | 0.24 | 0.03 | 0.005 |
| 2-10 | 1 | 0.2 | 0.3 | — | — | — | — | — | — | — | 0 | 0.5 | 0.02 | 0.004 |
| 2-11 | 1 | 0.2 | — | — | 0.005 | — | — | — | — | — | 0.005 | 0.205 | 0.01 | 0.002 |
| 2-12 | 1 | 0.2 | — | — | 0.05 | — | — | — | — | — | 0.05 | 0.25 | 0.02 | 0.004 |
| 2-13 | 1 | 0.2 | — | — | — | 0.005 | — | — | — | — | 0.005 | 0.205 | 0.01 | 0 |
| 2-14 | 1 | 0.2 | — | — | — | 0.05 | — | — | — | — | 0.05 | 0.25 | 0.01 | 0 |
| 2-15 | 1 | 0.2 | — | — | — | — | 0.005 | — | — | — | 0.005 | 0.205 | 0.02 | 0.004 |
| 2-16 | 1 | 0.2 | — | — | — | — | 0.05 | — | — | — | 0.05 | 0.25 | 0.02 | 0.004 |
| 2-17 | 1 | 0.2 | — | — | — | — | — | 0.005 | — | — | 0.005 | 0.205 | 0.02 | 0.004 |
| 2-18 | 1 | 0.2 | — | — | — | — | — | 0.2 | — | — | 0.2 | 0.4 | 0.02 | 0.004 |
| 2-19 | 1 | 0.2 | — | — | — | — | — | — | 0.005 | — | 0.005 | 0.205 | 0.01 | 0 |
| 2-20 | 1 | 0.2 | — | — | — | — | — | — | 0.05 | — | 0.05 | 0.25 | 0.02 | 0.004 |
| 2-21 | 1 | 0.2 | — | — | — | — | — | — | — | 0.005 | 0.005 | 0.205 | 0.01 | 0.002 |
| 2-22 | 1 | 0.2 | — | — | — | — | — | — | — | 0.01 | 0.01 | 0.21 | 0.02 | 0.004 |
| 2-23 | 1 | 0.2 | 0.03 | — | — | 0.005 | — | — | — | 0.005 | 0.01 | 0.24 | 0.01 | 0.002 |
| 2-201 | 3 | 0.8 | — | — | — | — | 3 | — | — | — | 3 | 3.8 | 0.01 | 0.002 |
| 2-202 | 1.05 | 0.2 | — | — | 0.05 | — | — | — | — | — | 0.05 | 0.25 | 0.02 | 0.005 |

TABLE 3

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 3-1 | 0.1 | — | — | 0.05 | — | — | — | — | — | — | 0 | 0.05 | 0.02 | 0.004 |
| 3-2 | 0.1 | — | — | 0.5 | — | — | — | — | — | — | 0 | 0.5 | 0.01 | 0.002 |
| 3-3 | 1 | — | — | 0.1 | — | — | — | — | — | — | 0 | 0.1 | 0.02 | 0 |
| 3-4 | 1.5 | — | — | 0.1 | — | — | — | — | — | — | 0 | 0.1 | 0.01 | 0.002 |
| 3-5 | 2.2 | — | — | 0.1 | — | — | — | — | — | — | 0 | 0.1 | 0 | 0 |
| 3-6 | 0.2 | 0.1 | — | 0.2 | — | — | — | — | — | — | 0 | 0.3 | 0.01 | 0 |
| 3-7 | 0.2 | — | 0.05 | 0.2 | — | — | — | — | — | — | 0 | 0.25 | 0.02 | 0.004 |
| 3-8 | 0.8 | — | — | 0.2 | — | 0.005 | — | — | — | — | 0.005 | 0.205 | 0.02 | 0.004 |
| 3-9 | 0.8 | — | — | 0.2 | — | — | — | — | 0.005 | — | 0.005 | 0.205 | 0.01 | 0.002 |
| 3-10 | 0.2 | 0.1 | 0.05 | 0.2 | — | — | — | — | — | — | 0 | 0.35 | 0.02 | 0.004 |
| 3-11 | 0.2 | 0.1 | 0.05 | 0.2 | — | — | 0.01 | — | — | — | 0.01 | 0.36 | 0.02 | 0.004 |
| 3-12 | 0.2 | 0.1 | 0.05 | 0.2 | — | — | — | — | 0.05 | — | — | — | 0.01 | 0.002 |
| 3-301 | 3 | — | — | 0.6 | — | — | — | — | — | — | 0 | 0.6 | 0.01 | 0.002 |
| 3-302 | 1.05 | 0.2 | 0.5 | 0.2 | — | — | — | — | — | — | 0 | 0.9 | 0.02 | 0.005 |

TABLE 4

| Sample | Alloy Composition [Mass %] | | | | | | | | | | | | | |
|---|---|---|---|---|---|---|---|---|---|---|---|---|---|---|
| | | | | | α | | | | | | | | | |
| No. | Fe | Mg | Si | Cu | Mn | Ni | Zr | Ag | Cr | Zn | Total | Total | Ti | B |
| 1-105 | 1 | — | — | — | — | — | — | — | — | — | 0 | 0 | 0.03 | 0.015 |
| 1-106 | 1 | — | — | — | — | — | — | — | — | — | 0 | 0 | 0.03 | 0.015 |
| 2-203 | 1 | 0.2 | — | — | — | — | — | — | — | — | 0 | 0.2 | 0.02 | 0.004 |
| 2-204 | 1 | 0.2 | — | — | — | — | — | — | — | — | 0 | 0.2 | 0.02 | 0.004 |
| 2-205 | 1 | 0.2 | — | — | — | — | — | — | — | — | 0 | 0.2 | 0.02 | 0.004 |
| 3-303 | 1 | — | — | 0.1 | — | — | — | — | — | — | 0 | 0.1 | 0.02 | 0 |

TABLE 5

| Sample No. | Manufacturing Conditions | | | | | |
|---|---|---|---|---|---|---|
| | | Casting Conditions | | | | |
| | Casting | Temperature of melt [° C.] | Cooling Rate [° C./sec] | Softening Treatment (Batch × 3H) | | |
| | | | | Method | Temperature [° C.] | Atmosphere |
| 1-1 | Billet | 740 | 2 | Bright Softening | 250 | Atmospheric Air |
| 1-2 | Continuous | 690 | 22 | Bright Softening | 250 | Reducing Gas |
| 1-3 | Continuous | 740 | 4 | Bright Softening | 350 | Reducing Gas |
| 1-4 | Continuous | 710 | 10 | Continuous Softening | 500 | Atmospheric Air |
| 1-5 | Continuous | 745 | 2 | Bright Softening | 300 | Nitrogen gas |
| 1-6 | Continuous | 720 | 3 | Bright Softening | 350 | Reducing Gas |
| 1-7 | Continuous | 700 | 7 | Continuous Softening | 500 | Atmospheric Air |
| 1-8 | Continuous | 680 | 4 | Bright Softening | 400 | Reducing Gas |
| 1-9 | Continuous | 720 | 2 | Bright Softening | 450 | Reducing Gas |
| 1-10 | Continuous | 670 | 9 | Continuous Softening | 500 | Atmospheric Air |
| 1-11 | Billet | 730 | 9 | Bright Softening | 250 | Atmospheric Air |
| 1-12 | Continuous | 740 | 2 | Bright Softening | 500 | Nitrogen gas |
| 1-13 | Continuous | 680 | 2 | Continuous Softening | 450 | Atmospheric Air |
| 1-14 | Continuous | 710 | 2 | Bright Softening | 450 | Reducing Gas |
| 1-15 | Continuous | 745 | 4 | Bright Softening | 250 | Atmospheric Air |
| 1-16 | Continuous | 740 | 4 | Bright Softening | 350 | Reducing Gas |
| 1-17 | Billet | 680 | 5 | Continuous Softening | 400 | Atmospheric Air |

TABLE 5-continued

| | Manufacturing Conditions | | | | | |
|---|---|---|---|---|---|---|
| | | Casting Conditions | | | | |
| | | Temperature | Cooling | Softening Treatment (Batch × 3H) | | |
| Sample No. | Casting | of melt [° C.] | Rate [° C./sec] | Method | Temperature [° C.] | Atmosphere |
| 1-18 | Continuous | 690 | 2 | Bright Softening | 300 | Reducing Gas |
| 1-19 | Continuous | 690 | 25 | Bright Softening | 250 | Reducing Gas |
| 1-20 | Continuous | 710 | 2 | Continuous Softening | 400 | Atmospheric Air |
| 1-21 | Billet | 730 | 1 | Bright Softening | 300 | Nitrogen gas |
| 1-22 | Continuous | 670 | 4 | Continuous Softening | 550 | Atmospheric Air |
| 1-23 | Continuous | 730 | 2 | Bright Softening | 350 | Reducing Gas |
| 1-101 | Continuous | 700 | 2 | Bright Softening | 250 | Reducing Gas |
| 1-102 | Continuous | 680 | 4 | Bright Softening | 400 | Reducing Gas |
| 1-103 | Continuous | 700 | 3 | Bright Softening | 400 | Reducing Gas |
| 1-104 | Continuous | 700 | 3 | Bright Softening | 250 | Reducing Gas |

TABLE 6

| | Manufacturing Conditions | | | | | |
|---|---|---|---|---|---|---|
| | | Casting Conditions | | | | |
| | | Temperature | Cooling | Softening Treatment (Batch × 3H) | | |
| Sample No. | Casting | of melt [° C.] | Rate [° C./sec] | Method | Temperature [° C.] | Atmosphere |
| 2-1 | Billet | 720 | 3 | Bright Softening | 300 | Reducing Gas |
| 2-2 | Billet | 720 | 4 | Bright Softening | 250 | Reducing Gas |
| 2-3 | Continuous | 720 | 10 | Bright Softening | 325 | Nitrogen Gas |
| 2-4 | Continuous | 745 | 3 | Continuous Softening | 500 | Atmospheric Air |
| 2-5 | Continuous | 700 | 2 | Bright Softening | 350 | Reducing Gas |
| 2-6 | Continuous | 700 | 6 | Batch Softening | 350 | Reducing Gas |
| 2-7 | Billet | 680 | 5 | Bright Softening | 250 | Reducing Gas |
| 2-8 | Continuous | 740 | 2 | Bright Softening | 400 | Reducing Gas |
| 2-9 | Continuous | 720 | 4 | Continuous Softening | 500 | Atmospheric Air |
| 2-10 | Continuous | 680 | 2 | Bright Softening | 400 | Nitrogen gas |
| 2-11 | Continuous | 690 | 3 | Bright Softening | 350 | Nitrogen gas |
| 2-12 | Continuous | 670 | 2 | Bright Softening | 300 | Reducing Gas |
| 2-13 | Billet | 670 | 20 | Bright Softening | 325 | Reducing Gas |
| 2-14 | Continuous | 710 | 3 | Bright Softening | 275 | Nitrogen gas |
| 2-15 | Continuous | 710 | 2 | Bright Softening | 300 | Reducing Gas |
| 2-16 | Continuous | 730 | 2 | Bright Softening | 350 | Reducing Gas |
| 2-17 | Continuous | 680 | 4 | Bright Softening | 300 | Reducing Gas |
| 2-18 | Continuous | 670 | 2 | Bright Softening | 350 | Reducing Gas |
| 2-19 | Continuous | 740 | 1 | Continuous Softening | 500 | Atmospheric Air |
| 2-20 | Continuous | 700 | 8 | Bright Softening | 350 | Nitrogen gas |
| 2-21 | Continuous | 690 | 6 | Continuous Softening | 500 | Atmospheric Air |
| 2-22 | Continuous | 690 | 20 | Bright Softening | 300 | Reducing Gas |
| 2-23 | Billet | 720 | 2 | Bright Softening | 350 | Reducing Gas |
| 2-201 | Continuous | 745 | 2 | Bright Softening | 350 | Reducing Gas |
| 2-202 | Continuous | 670 | 11 | None | None | None |

TABLE 7

| Sample No. | Manufacturing Conditions: Casting | Casting Conditions: Temperature of melt [° C.] | Casting Conditions: Cooling Rate [° C./sec] | Softening Treatment (Batch × 3H): Method | Softening Treatment (Batch × 3H): Temperature [° C.] | Softening Treatment (Batch × 3H): Atmosphere |
|---|---|---|---|---|---|---|
| 3-1 | Continuous | 690 | 2 | Bright Softening | 275 | Nitrogen gas |
| 3-2 | Continuous | 680 | 6 | Continuous Softening | 500 | Atmospheric Air |
| 3-3 | Continuous | 690 | 4 | Bright Softening | 300 | Nitrogen gas |
| 3-4 | Continuous | 710 | 2 | Continuous Softening | 475 | Atmospheric Air |
| 3-5 | Continuous | 740 | 2 | Bright Softening | 300 | Nitrogen gas |
| 3-6 | Billet | 690 | 2 | Bright Softening | 350 | Reducing Gas |
| 3-7 | Continuous | 700 | 2 | Bright Softening | 250 | Reducing Gas |
| 3-8 | Continuous | 730 | 2 | Continuous Softening | 525 | Atmospheric Air |
| 3-9 | Continuous | 690 | 6 | Bright Softening | 275 | Atmospheric Air |
| 3-10 | Billet | 700 | 2 | Bright Softening | 350 | Reducing Gas |
| 3-11 | Continuous | 680 | 19 | Bright Softening | 325 | Reducing Gas |
| 3-12 | Continuous | 680 | 2 | Bright Softening | 350 | Atmospheric Air |
| 3-301 | Continuous | 690 | 2 | Bright Softening | 350 | Reducing Gas |
| 3-302 | Continuous | 660 | 3 | Bright Softening | 350 | Reducing Gas |

TABLE 8

| Sample No. | Manufacturing Conditions: Casting | Casting Conditions: Temperature of melt [° C.] | Casting Conditions: Cooling Rate [° C./sec] | Softening Treatment (Batch × 3H): Method | Softening Treatment (Batch × 3H): Temperature [° C.] | Softening Treatment (Batch × 3H): Atmosphere |
|---|---|---|---|---|---|---|
| 1-105 | Continuous | 820 | 2 | Bright Softening | 300 | Nitrogen gas |
| 1-106 | Continuous | 750 | 25 | Bright Softening | 300 | Nitrogen gas |
| 2-203 | Continuous | 720 | 2 | Bright Softening | *1 | Reducing Gas |
| 2-204 | Continuous | 850 | 0.2 | Bright Softening | 350 | Reducing Gas |
| 2-205 | Continuous | 690 | 2 | Bright Softening | 350 | *2 |
| 3-303 | Continuous | 850 | 4 | Bright Softening | 300 | Nitrogen gas |

(Mechanical Characteristics and Electrical Characteristics)

As to the obtained softened member and non-heat-treated member (sample No. 2-202) having a wire diameter of ϕ 0.3 mm, the tensile strength (MPa), the 0.2% proof stress (MPa), the breaking elongation (%), the work hardening exponent, and the electrical conductivity (% IACS) were measured. Also, the ratio "proof stress/tensile" of the 0.2% proof stress to the tensile strength was calculated. These results are shown in Tables 9 to 12.

The tensile strength (MPa), the 0.2% proof stress (MPa) and the breaking elongation (%) were measured by using a general tensile testing machine on the basis of JIS Z 2241 (Tensile testing method for metallic materials, 1998). The work hardening exponent is defined as an exponent n of true a strain s in an expression $\sigma=C\times\varepsilon^{n}$ of true stress σ and true strain ε in a plastic strain region obtained when the test force of the tensile test is applied in the single axis direction. In the above-mentioned expression, C is a strength constant. The above-mentioned exponent n is calculated by creating an S-S curve by performing a tensile test using the above-mentioned tensile testing machine (also see JIS G 2253 in 2011). The electrical conductivity (% IACS) was measured by the bridge method.

(Fatigue Characteristics)

The obtained softened member and non-heat-treated member (sample No. 2-202) each having a wire diameter of ϕ 0.3 mm were subjected to a bending test to measure the number of times of bending until occurrence of breakage. The bending test was measured using a commercially available repeated-bending test machine. In this case, a jig capable of applying 0.3% of bending distortion to the wire member of each sample is used to perform repeated bending in the state where a load of 12.2 MPa is applied. The bending test is performed for three or more materials for each sample, and the average (the number) of times of bending is shown in Tables 9 to 12. It is recognized that as the number of times of bending performed until occurrence of breakage is greater, breakage resulting from repeated bending is less likely to occur, which leads to excellent fatigue characteristics.

TABLE 9

| | φ 0.3 mm | | | | | | |
|---|---|---|---|---|---|---|---|
| Sample No. | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 1-1 | 0.41 | 110 | 45 | 61 | 30 | 10243 | 0.15 |
| 1-2 | 0.41 | 114 | 47 | 61 | 25 | 11069 | 0.12 |
| 1-3 | 0.50 | 111 | 56 | 62 | 30 | 12344 | 0.15 |
| 1-4 | 0.46 | 115 | 53 | 60 | 35 | 12256 | 0.17 |
| 1-5 | 0.48 | 116 | 56 | 62 | 34 | 14090 | 0.17 |
| 1-6 | 0.60 | 127 | 76 | 60 | 25 | 15344 | 0.12 |
| 1-7 | 0.41 | 131 | 54 | 60 | 24 | 14226 | 0.12 |
| 1-8 | 0.55 | 132 | 73 | 58 | 15 | 12651 | 0.07 |
| 1-9 | 0.49 | 110 | 54 | 60 | 28 | 10494 | 0.14 |
| 1-10 | 0.51 | 120 | 62 | 55 | 15 | 13077 | 0.07 |
| 1-11 | 0.50 | 111 | 55 | 60 | 25 | 11299 | 0.12 |
| 1-12 | 0.51 | 125 | 64 | 55 | 24 | 14923 | 0.12 |
| 1-13 | 0.48 | 112 | 53 | 61 | 28 | 10460 | 0.14 |
| 1-14 | 0.50 | 118 | 58 | 59 | 24 | 11895 | 0.12 |
| 1-15 | 0.52 | 120 | 63 | 60 | 20 | 11577 | 0.10 |
| 1-16 | 0.52 | 135 | 70 | 56 | 28 | 12819 | 0.14 |
| 1-17 | 0.52 | 116 | 61 | 60 | 25 | 10683 | 0.12 |
| 1-18 | 0.48 | 117 | 56 | 60 | 33 | 12893 | 0.16 |
| 1-19 | 0.50 | 115 | 58 | 59 | 23 | 10683 | 0.11 |
| 1-20 | 0.50 | 123 | 61 | 58 | 30 | 15078 | 0.15 |
| 1-21 | 0.49 | 115 | 56 | 61 | 32 | 12325 | 0.16 |
| 1-22 | 0.50 | 130 | 66 | 58 | 31 | 14804 | 0.15 |
| 1-23 | 0.52 | 125 | 65 | 58 | 20 | 15292 | 0.10 |
| 1-101 | 0.51 | 105 | 54 | 59 | 12 | 11097 | 0.06 |
| 1-102 | 0.49 | 69 | 34 | 63 | 25 | 6730 | 0.12 |
| 1-103 | 0.53 | 106 | 56 | 59 | 30 | 11855 | 0.15 |
| 1-104 | 0.50 | 135 | 68 | 58 | 15 | 8281 | 0.07 |

TABLE 10

| | φ 0.3 mm | | | | | | |
|---|---|---|---|---|---|---|---|
| Sample No. | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 2-1 | 0.48 | 120 | 58 | 57 | 33 | 14511 | 0.16 |
| 2-2 | 0.47 | 120 | 56 | 60 | 12 | 13367 | 0.06 |
| 2-3 | 0.51 | 122 | 62 | 59 | 24 | 13451 | 0.12 |
| 2-4 | 0.54 | 121 | 65 | 59 | 25 | 12118 | 0.12 |
| 2-5 | 0.52 | 122 | 63 | 60 | 25 | 11235 | 0.12 |
| 2-6 | 0.52 | 120 | 62 | 60 | 28 | 12563 | 0.14 |
| 2-7 | 0.46 | 133 | 62 | 60 | 17 | 13739 | 0.08 |
| 2-8 | 0.48 | 128 | 62 | 57 | 25 | 14126 | 0.12 |
| 2-9 | 0.52 | 123 | 64 | 60 | 24 | 11349 | 0.12 |
| 2-10 | 0.49 | 122 | 60 | 59 | 23 | 13511 | 0.11 |
| 2-11 | 0.51 | 121 | 62 | 59 | 25 | 14317 | 0.12 |
| 2-12 | 0.46 | 128 | 60 | 58 | 22 | 11882 | 0.11 |
| 2-13 | 0.50 | 120 | 60 | 59 | 28 | 13121 | 0.14 |
| 2-14 | 0.47 | 129 | 61 | 59 | 20 | 12673 | 0.10 |
| 2-15 | 0.50 | 122 | 61 | 60 | 26 | 12815 | 0.13 |
| 2-16 | 0.50 | 129 | 65 | 57 | 27 | 13494 | 0.13 |
| 2-17 | 0.50 | 124 | 61 | 59 | 24 | 11491 | 0.12 |
| 2-18 | 0.52 | 130 | 68 | 59 | 24 | 13068 | 0.12 |
| 2-19 | 0.47 | 122 | 57 | 60 | 26 | 13013 | 0.13 |
| 2-20 | 0.52 | 125 | 65 | 55 | 24 | 14398 | 0.12 |

TABLE 10-continued

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 2-21 | 0.50 | 120 | 60 | 58 | 27 | 12916 | 0.13 |
| 2-22 | 0.52 | 150 | 78 | 55 | 15 | 15440 | 0.07 |
| 2-23 | 0.46 | 129 | 60 | 58 | 21 | 12423 | 0.10 |
| 2-201 | 0.54 | 170 | 92 | 40 | 7 | 17446 | 0.03 |
| 2-202 | 0.50 | 231 | 115 | 56 | 2 | 24473 | 0.01 |

TABLE 11

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 3-1 | 0.49 | 113 | 55 | 61 | 18 | 12204 | 0.09 |
| 3-2 | 0.51 | 152 | 77 | 57 | 11 | 15336 | 0.05 |
| 3-3 | 0.50 | 120 | 61 | 61 | 30 | 14395 | 0.15 |
| 3-4 | 0.57 | 131 | 75 | 60 | 27 | 16040 | 0.13 |
| 3-5 | 0.53 | 132 | 69 | 59 | 27 | 15415 | 0.13 |
| 3-6 | 0.51 | 117 | 60 | 60 | 13 | 11100 | 0.06 |
| 3-7 | 0.51 | 120 | 62 | 59 | 15 | 13878 | 0.07 |
| 3-8 | 0.48 | 117 | 56 | 61 | 30 | 12825 | 0.15 |
| 3-9 | 0.48 | 119 | 57 | 60 | 28 | 11589 | 0.14 |
| 3-10 | 0.46 | 120 | 55 | 60 | 15 | 11979 | 0.07 |
| 3-11 | 0.46 | 125 | 58 | 60 | 16 | 11682 | 0.08 |
| 3-12 | 0.51 | 126 | 65 | 59 | 17 | 15196 | 0.08 |
| 3-301 | 0.49 | 184 | 91 | 56 | 9 | 19927 | 0.04 |
| 3-302 | 0.48 | 130 | 63 | 57 | 8 | 15243 | 0.04 |

TABLE 12

| Sample No. | φ 0.3 mm | | | | | | |
|---|---|---|---|---|---|---|---|
| | Proof Stress/ Tensile | Tensile Strength [MPa] | 0.2% Proof Stress [MPa] | Electrical Conductivity [% IACS] | Breaking Elongation [%] | Bending [Number of Times] | Work Hardening Exponent |
| 1-105 | 0.45 | 104 | 47 | 62 | 33 | 10990 | 0.16 |
| 1-106 | 0.46 | 108 | 50 | 62 | 33 | 11523 | 0.16 |
| 2-203 | 0.53 | 117 | 62 | 60 | 18 | 10742 | 0.15 |
| 2-204 | 0.48 | 112 | 54 | 60 | 24 | 7235 | 0.11 |
| 2-205 | 0.51 | 124 | 63 | 60 | 25 | 12337 | 0.12 |
| 3-303 | 0.49 | 108 | 53 | 61 | 27 | 11468 | 0.15 |

The obtained wire-drawn member (not subjected to the above-mentioned softening treatment) having a wire diameter of ϕ 0.37 mm or a wire diameter of ϕ 0.39 mm is used to produce a strand wire. In this case, the strand wire formed using seven wire members each having a wire diameter of ϕ 0.37 mm is produced. Also, a strand wire formed using seven wire members each having a wire diameter of ϕ 0.39 mm is further compression-molded to thereby produce a compressed strand wire. Each of the cross-sectional area of the strand wire and the cross-sectional area of the compressed strand wire is 0.75 $mm^2$ (0.75 sq). The strand pitch is 25 mm (approximately 33 times as high as the pitch diameter).

The obtained strand wire and compressed strand wire are subjected to softening treatment by the method, at the temperature (° C.) and in the atmosphere shown in Tables 5 to 8 (with regard to *1 in Sample No. 2-203 and *2 in Sample No. 2-205, see the above). The obtained softened strand wire is used as a conductor to form an insulation cover (0.2 mm in thickness) with an insulating material (in this case, a halogen-free insulating material) on the outer circumference of the conductor, to thereby produce a covered electrical wire. As to sample No. 2-202, each of the wire-drawn member and the strand wire is not subjected to softening treatment.

The obtained covered electrical wire of each sample, or the terminal-equipped electrical wire obtained by attaching a crimp terminal to this covered electrical wire was examined regarding the following items. The following items were checked for each of the covered electrical wire including a strand wire as a conductor and the covered electrical wire including a compressed strand wire as a conductor. Tables 13 to 16 show the results obtained in the case of a strand wire used as a conductor, which were compared with the results obtained in the case of a compressed strand wire used as a conductor, to thereby check that there is no significant difference therebetween.

(Observation of Structure)

Voids

A conductor (a strand wire or a compressed strand wire formed of Al alloy wires; the rest is the same as above) in a transverse section of the covered electrical wire of each of the obtained samples was observed by a scanning electron microscope (SEM) to check the voids and the crystal grain sizes in the surface layer and inside thereof. In this case, a surface-layer void measurement region in a shape of a rectangle having a short side length of 30 μm and a long side length of 50 μm is defined within a surface layer region extending from a surface of each aluminum alloy wire forming a conductor by 30 μm in the depth direction. In other words, for one sample, one surface-layer void measurement region is defined in each of seven Al alloy wires forming a strand wire to thereby define a total of seven surface-layer void measurement regions. Then, the total cross-sectional area of the voids existing in each surface-layer void measurement region is calculated. The total cross-sectional area of voids in the total seven surface-layer void measurement regions is checked for each sample. Tables 13 to 16 each show, as a total area A ($\mu m^2$), the value obtained by averaging the total cross-sectional areas of voids in the total seven measurement regions.

In place of the above-mentioned rectangular surface-layer void measurement region, a sector-shaped void measurement region having an area of 1500 $\mu m^2$ was defined in an annular surface layer region having a thickness of 30 μm. Then, in the same manner as with evaluation of the above-mentioned rectangular surface-layer void measurement region, a total area B ($\mu m^2$) of voids in the sector-shaped void measurement region was calculated. The results thereof are shown in Tables 13 to 16.

The measurement of the total cross-sectional area of voids can be readily performed by subjecting the observed image to image processing such as binarization processing so as to extract voids from the processed image.

In the above-mentioned transverse section, an inside void measurement region in a shape of a rectangle having a short side length of 30 μm and a long side length of 50 μm is defined in each of the Al alloy wires forming a conductor. The inside void measurement region is defined such that the center of the rectangle coincides with the center of each Al alloy wire. Then, the ratio "inside/surface layer" of the total cross-sectional area of the voids existing in the inside void measurement region to the total cross-sectional area of the voids existing in the surface-layer void measurement region is calculated. The ratio "inside/surface layer" is calculated for the total seven surface-layer void measurement regions and inside void measurement regions for each sample. The value obtained by averaging the ratios "inside/surface layer" in the total seven measurement regions is shown as a ratio "inside/surface layer A" in Tables 13 to 16. In the same manner as with evaluation of the above-mentioned rectangular surface-layer void measurement region, the above-mentioned ratio "inside/surface layer B" in the case of the above-mentioned sector-shaped void measurement region is calculated, and the results thereof are shown in Tables 13 to 16.

Crystal Grain Size

Also, in the above-mentioned transverse section, on the basis of JIS G 0551 (Steels-Micrographic determination of the grain size, 2013), a test line is drawn in the SEM observation image and the length sectioning the test line in each crystal grain is defined as a crystal grain size (cutting method). The length of the test line is defined to such an extent that ten or more crystal grains are sectioned by this test line. Then, three test lines are drawn on one transverse section to calculate each crystal grain size. Then, the averaged value of these crystal grain sizes is shown as an average crystal grain size (μm) in Tables 13 to 16.

(Hydrogen Content)

From the covered electrical wire of each of the obtained samples, the insulation cover was removed to obtain a conductor alone. Then, the hydrogen content per conductor 100 g (ml/100 g) was measured. The results thereof are shown in Tables 13 to 16. The hydrogen content is measured by the inert gas fusion method. Specifically, a sample is introduced into a graphite crucible in an argon air flow and heated and melted, thereby extracting hydrogen together with other gas. The extracted gas is caused to flow through a separation column to separate hydrogen from other gas and measure the separated hydrogen by a heat conductivity detector to quantify the concentration of hydrogen, thereby calculating the hydrogen content.

(Surface Oxide Film)

From the covered electrical wire of each of the obtained samples, the insulation cover was removed to obtain a conductor alone. Then, the strand wire or the compressed strand wire forming a conductor was unbound, and the surface oxide film of each elemental wire was measured as follows. In this case, the thickness of the surface oxide film of each elemental wire (Al alloy wire) is examined. The thickness of the surface oxide film in each of the total seven elemental wires is checked for each sample. Then, the averaged value of the thicknesses of the surface oxide films of the total seven elemental wires is shown as a thickness (nm) of the surface oxide film in Tables 13 to 16. Cross section polisher (CP) treatment is performed to define a cross section of each elemental wire. Then, the defined cross section is subjected to SEM observation. In the case of a relatively thick oxide film having a thickness exceeding about 50 nm, the thickness is measured using this SEM observation image. When a relatively thin oxide film having a thickness of equal to or less than about 50 nm is seen in the SEM observation, an analysis in the depth direction (repeating sputtering and an analysis by energy dispersive X-ray analysis (EDX)) is separately performed by X-ray photoelectron spectrometry (ESCA) for measurement.

(Impact Resistance)

For the covered electrical wire of each of the obtained samples, an impact resistance (J/m) was evaluated with reference to PTL 1. More specifically, a weight is attached to the end portion of the sample at the distance between evaluation points of 1 m. After the weight is raised upward by 1 m, the weight is caused to freely fall. Then, the largest mass (kg) of the weight with no disconnection occurring in the sample is measured. The value obtained by dividing the product value, which is obtained by multiplying the gravitational acceleration (9.8 $m/s^2$) and 1 m of falling distance by the mass of this weight, by the falling distance (1 m) is defined as an evaluation parameter (J/m or (N·m)/m) of the impact resistance. The value obtained by dividing the obtained evaluation parameter of the impact resistance by the conductor cross-sectional area (0.75 $mm^2$ in this case) is shown in Tables 13 to 16 as an evaluation parameter ($J/m \cdot mm^2$) of the impact resistance per unit area.

(Terminal Fixing Force)

For the terminal-equipped electrical wire of each of the obtained samples, terminal fixing force (N) was evaluated with reference to PTL 1. Schematically, the terminal portion attached to one end of the terminal-equipped electrical wire is sandwiched by a terminal chuck to remove the insulation cover at the other end of the covered electrical wire, and then, the conductor portion is held by a conductor chuck. For the terminal-equipped electrical wire of each sample held at its both ends by both chucks, the maximum load (N) at the time of breakage is measured using a general-purpose tensile testing machine to evaluate the maximum load (N) as terminal fixing force (N). The value obtained by dividing the calculated maximum load by the conductor cross-sectional area (0.75 $mm^2$ in this case) is shown in Tables 13 to 16 as terminal fixing force per unit area ($N/mm^2$).

TABLE 13

| | 0.75 sq (Strand Wire Formed of 7 Members of φ 0.37 mm or Compressed Strand Wire Formed of 7 Members of φ 0.39 mm) | | | | | | | | | | |
|---|---|---|---|---|---|---|---|---|---|---|---|
| Sample No. | Void Surface-Layer Total Area A [$\mu m^2$] | Void Surface-Layer Total Area B [$\mu m^2$] | Void Area Ratio Inside/Surface Layer A | Void Area Ratio Inside/Surface Layer B | Hydrogen Concentration [ml/100 g] | Average Crystal Grain Size [μm] | Oxide Film Thickness [nm] | Impact Resistance [J/m] | Impact Resistance Unit Area [J/m·$mm^2$] | Terminal Fixing Force [N] | Terminal Fixing Force Unit Area [$N/mm^2$] |
| 1-1 | 1.4 | 1.4 | 5.2 | 5.3 | 3.4 | 5 | 51 | 12 | 16 | 58 | 78 |
| 1-2 | 0.8 | 0.8 | 1.1 | 1.1 | 1.1 | 13 | 42 | 12 | 17 | 60 | 80 |
| 1-3 | 1.8 | 1.8 | 2.5 | 2.5 | 3.3 | 6 | 30 | 15 | 19 | 63 | 84 |
| 1-4 | 1.4 | 1.4 | 1.1 | 1.1 | 2.1 | 6 | 103 | 18 | 23 | 63 | 84 |
| 1-5 | 1.7 | 1.6 | 5.2 | 5.1 | 3.5 | 4 | 55 | 17 | 23 | 64 | 86 |
| 1-6 | 1.8 | 1.9 | 3.8 | 3.9 | 2.9 | 1 | 27 | 16 | 21 | 76 | 102 |
| 1-7 | 0.9 | 0.9 | 1.6 | 1.6 | 1.6 | 25 | 110 | 14 | 18 | 69 | 92 |
| 1-8 | 0.8 | 0.8 | 3.1 | 3.2 | 0.9 | 7 | 18 | 10 | 13 | 77 | 102 |
| 1-9 | 1.4 | 1.4 | 6.5 | 6.3 | 2.4 | 20 | 19 | 13 | 18 | 62 | 82 |
| 1-10 | 0.3 | 0.2 | 1.3 | 1.3 | 0.3 | 5 | 111 | 10 | 13 | 68 | 91 |
| 1-11 | 1.5 | 1.5 | 1.3 | 1.2 | 3.1 | 11 | 60 | 12 | 16 | 62 | 83 |
| 1-12 | 1.4 | 1.5 | 5.5 | 5.6 | 3.4 | 17 | 41 | 13 | 17 | 71 | 94 |
| 1-13 | 0.5 | 0.5 | 4.8 | 4.6 | 0.8 | 28 | 108 | 14 | 18 | 62 | 83 |
| 1-14 | 1.2 | 1.2 | 4.6 | 4.5 | 2.3 | 15 | 5 | 12 | 16 | 66 | 88 |
| 1-15 | 1.9 | 2.0 | 2.7 | 2.6 | 3.7 | 48 | 82 | 10 | 14 | 68 | 91 |
| 1-16 | 1.9 | 2.0 | 2.8 | 2.7 | 3.4 | 19 | 6 | 16 | 22 | 77 | 103 |
| 1-17 | 0.6 | 0.6 | 2.2 | 2.2 | 0.7 | 9 | 95 | 13 | 17 | 66 | 88 |
| 1-18 | 1.0 | 1.0 | 4.6 | 4.4 | 1.6 | 16 | 10 | 17 | 22 | 65 | 86 |
| 1-19 | 0.7 | 0.7 | 1.1 | 1.1 | 1.3 | 2 | 41 | 12 | 15 | 65 | 87 |
| 1-20 | 1.6 | 1.5 | 5.0 | 4.8 | 2.3 | 34 | 69 | 16 | 21 | 69 | 92 |
| 1-21 | 1.5 | 1.5 | 11.0 | 11.0 | 3.2 | 4 | 27 | 16 | 21 | 64 | 86 |
| 1-22 | 0.5 | 0.4 | 2.5 | 2.6 | 0.4 | 17 | 111 | 18 | 23 | 73 | 98 |
| 1-23 | 1.4 | 1.4 | 4.8 | 5.0 | 2.7 | 16 | 19 | 11 | 15 | 71 | 95 |
| 1-101 | 0.8 | 0.7 | 6.1 | 6.0 | 1.5 | 17 | 34 | 5 | 7 | 60 | 79 |
| 1-102 | 0.6 | 0.5 | 2.6 | 2.6 | 0.8 | 6 | 19 | 7 | 10 | 38 | 51 |
| 1-103 | 0.8 | 0.8 | 4.1 | 4.2 | 1.6 | 3 | 13 | 11 | 15 | 61 | 81 |
| 1-104 | 0.9 | 0.8 | 3.7 | 3.5 | 1.5 | 3 | 15 | 9 | 12 | 76 | 101 |

TABLE 14

| | 0.75 sq (Strand Wire Formed of 7 Members of φ 0.37 mm or Compressed Strand Wire Formed of 7 Members of φ 0.39 mm) | | | | | | | | | | |
|---|---|---|---|---|---|---|---|---|---|---|---|
| Sample No. | Void Surface-Layer Total Area A [$\mu m^2$] | Void Surface-Layer Total Area B [$\mu m^2$] | Void Area Ratio Inside/Surface Layer A | Void Area Ratio Inside/Surface Layer B | Hydrogen Concentration [ml/100 g] | Average Crystal Grain Size [μm] | Oxide Film Thickness [nm] | Impact Resistance [J/m] | Impact Resistance Unit Area [J/m·$mm^2$] | Terminal Fixing Force [N] | Terminal Fixing Force Unit Area [$N/mm^2$] |
| 2-1 | 1.3 | 1.2 | 4.1 | 3.9 | 2.6 | 19 | 13 | 17 | 23 | 67 | 89 |
| 2-2 | 1.9 | 1.8 | 3.0 | 2.9 | 2.9 | 37 | 21 | 10 | 13 | 66 | 88 |
| 2-3 | 1.1 | 1.1 | 1.1 | 1.1 | 2.4 | 24 | 41 | 13 | 17 | 69 | 92 |
| 2-4 | 2.0 | 2.1 | 3.5 | 3.4 | 4.0 | 12 | 120 | 13 | 18 | 70 | 93 |
| 2-5 | 1.0 | 1.0 | 5.8 | 5.7 | 2.1 | 6 | 31 | 13 | 18 | 69 | 93 |
| 2-6 | 0.5 | 0.6 | 1.8 | 1.9 | 0.4 | 3 | 5 | 15 | 20 | 68 | 91 |
| 2-7 | 0.8 | 0.8 | 2.2 | 2.3 | 0.9 | 15 | 15 | 10 | 13 | 73 | 97 |
| 2-8 | 1.6 | 1.6 | 4.6 | 4.6 | 3.6 | 22 | 1 | 14 | 19 | 71 | 95 |
| 2-9 | 1.3 | 1.3 | 3.1 | 3.2 | 2.3 | 19 | 103 | 13 | 17 | 70 | 94 |
| 2-10 | 0.9 | 0.9 | 6.9 | 7.1 | 1.1 | 8 | 49 | 12 | 16 | 68 | 91 |
| 2-11 | 0.7 | 0.8 | 3.3 | 3.3 | 1.2 | 12 | 61 | 13 | 18 | 68 | 91 |
| 2-12 | 0.3 | 0.4 | 4.6 | 4.6 | 0.4 | 2 | 11 | 12 | 16 | 70 | 94 |
| 2-13 | 0.2 | 0.3 | 1.2 | 1.2 | 0.2 | 18 | 10 | 15 | 20 | 67 | 90 |
| 2-14 | 1.3 | 1.2 | 3.4 | 3.5 | 2.5 | 16 | 46 | 11 | 15 | 71 | 95 |
| 2-15 | 1.4 | 1.3 | 5.8 | 5.8 | 2.0 | 12 | 10 | 14 | 18 | 69 | 92 |
| 2-16 | 1.9 | 1.8 | 6.9 | 6.6 | 2.9 | 12 | 5 | 15 | 20 | 73 | 97 |
| 2-17 | 0.5 | 0.5 | 2.6 | 2.4 | 0.7 | 13 | 19 | 13 | 17 | 70 | 93 |
| 2-18 | 0.4 | 0.3 | 4.8 | 5.0 | 0.3 | 2 | 13 | 14 | 18 | 74 | 99 |
| 2-19 | 1.7 | 1.7 | 7.9 | 7.8 | 3.6 | 27 | 106 | 14 | 18 | 67 | 90 |
| 2-20 | 1.1 | 1.0 | 1.4 | 1.4 | 1.8 | 2 | 39 | 13 | 17 | 71 | 95 |
| 2-21 | 0.7 | 0.8 | 2.0 | 1.9 | 1.3 | 19 | 115 | 14 | 19 | 68 | 90 |

TABLE 14-continued

| Sample No. | 0.75 sq (Strand Wire Formed of 7 Members of φ 0.37 mm or Compressed Strand Wire Formed of 7 Members of φ 0.39 mm) | | | | | | | | | | |
|---|---|---|---|---|---|---|---|---|---|---|---|
| | Void Surface-Layer Total Area A [μm²] | Void Surface-Layer Total Area B [μm²] | Void Area Ratio Inside/Surface Layer A | Void Area Ratio Inside/Surface Layer B | Hydrogen Concentration [ml/100 g] | Average Crystal Grain Size [μm] | Oxide Film Thickness [nm] | Impact Resistance [J/m] | Impact Resistance Unit Area [J/m·mm²] | Terminal Fixing Force [N] | Terminal Fixing Force Unit Area [N/mm²] |
| 2-22 | 0.6 | 0.7 | 1.1 | 1.1 | 1.1 | 20 | 23 | 10 | 13 | 85 | 114 |
| 2-23 | 1.2 | 1.1 | 5.0 | 4.9 | 2.8 | 17 | 10 | 12 | 16 | 71 | 94 |
| 2-201 | 1.9 | 1.8 | 6.1 | 6.1 | 3.7 | 13 | 10 | 5 | 7 | 98 | 131 |
| 2-202 | 0.7 | 0.7 | 1.0 | 1.0 | 0.7 | 10 | 6 | 2 | 3 | 130 | 173 |

TABLE 15

| Sample No. | 0.75 sq (Strand Wire Formed of 7 Members of φ 0.37 mm or Compressed Strand Wire Formed of 7 Members of φ 0.39 mm) | | | | | | | | | | |
|---|---|---|---|---|---|---|---|---|---|---|---|
| | Void Surface-Layer Total Area A [μm²] | Void Surface-Layer Total Area B [μm²] | Void Area Ratio Inside/Surface Layer A | Void Area Ratio Inside/Surface Layer B | Hydrogen Concentration [ml/100 g] | Average Crystal Grain Size [μm] | Oxide Film Thickness [nm] | Impact Resistance [J/m] | Impact Resistance Unit Area [J/m·mm²] | Terminal Fixing Force [N] | Terminal Fixing Force Unit Area [N/mm²] |
| 3-1 | 1.0 | 0.9 | 4.8 | 4.9 | 1.5 | 17 | 28 | 11 | 15 | 63 | 84 |
| 3-2 | 0.8 | 0.7 | 1.9 | 1.9 | 1.0 | 6 | 111 | 10 | 13 | 86 | 115 |
| 3-3 | 0.7 | 0.6 | 2.5 | 2.5 | 1.1 | 32 | 21 | 16 | 21 | 68 | 90 |
| 3-4 | 1.2 | 1.1 | 6.9 | 6.9 | 2.3 | 18 | 97 | 15 | 21 | 77 | 103 |
| 3-5 | 1.9 | 1.9 | 5.8 | 5.6 | 3.3 | 13 | 43 | 16 | 21 | 76 | 101 |
| 3-6 | 1.1 | 1.0 | 5.5 | 5.4 | 1.4 | 29 | 12 | 10 | 13 | 66 | 89 |
| 3-7 | 1.0 | 0.9 | 5.5 | 5.6 | 1.5 | 17 | 47 | 11 | 15 | 68 | 91 |
| 3-8 | 1.9 | 1.9 | 6.9 | 6.7 | 3.3 | 5 | 98 | 15 | 20 | 65 | 87 |
| 3-9 | 0.8 | 0.8 | 2.0 | 1.9 | 1.6 | 7 | 47 | 15 | 19 | 66 | 88 |
| 3-10 | 1.3 | 1.3 | 4.6 | 4.7 | 2.1 | 12 | 10 | 10 | 13 | 66 | 88 |
| 3-11 | 0.8 | 0.7 | 1.1 | 1.1 | 1.1 | 17 | 10 | 11 | 15 | 69 | 91 |
| 3-12 | 0.5 | 0.6 | 4.6 | 4.7 | 0.9 | 3 | 72 | 11 | 15 | 71 | 95 |
| 3-301 | 0.7 | 0.7 | 5.5 | 5.4 | 1.4 | 2 | 9 | 7 | 10 | 103 | 137 |
| 3-302 | 0.3 | 0.2 | 3.2 | 3.2 | 0.3 | 13 | 18 | 5 | 6 | 72 | 96 |

TABLE 16

| Sample No. | 0.75 sq (Strand Wire Formed of 7 Members of φ 0.37 mm or Compressed Strand Wire Formed of 7 Members of φ 0.39 mm) | | | | | | | | | | |
|---|---|---|---|---|---|---|---|---|---|---|---|
| | Void Surface-Layer Total Area A [μm²] | Void Surface-Layer Total Area B [μm²] | Void Area Ratio Inside/Surface Layer A | Void Area Ratio Inside/Surface Layer B | Hydrogen Concentration [ml/100 g] | Average Crystal Grain Size [μm] | Oxide Film Thickness [nm] | Impact Resistance [J/m] | Impact Resistance Unit Area [J/m·mm²] | Terminal Fixing Force [N] | Terminal Fixing Force Unit Area [N/mm²] |
| 1-105 | 4.8 | 4.8 | 5.5 | 5.7 | 6.5 | 5 | 60 | 14 | 18 | 61 | 81 |
| 1-106 | 2.1 | 2.1 | 1.5 | 1.4 | 4.2 | 5 | 45 | 15 | 20 | 62 | 83 |
| 2-203 | 1.1 | 1.0 | 6.5 | 6.4 | 2.4 | 84 | 29 | 11 | 15 | 66 | 88 |
| 2-204 | 4.5 | 4.5 | 45.0 | 45.0 | 7.2 | 5 | 28 | 9 | 12 | 65 | 87 |
| 2-205 | 1.1 | 1.1 | 5.2 | 5.2 | 1.4 | 9 | 250 | 13 | 18 | 53 | 71 |
| 3-303 | 5.5 | 5.5 | 2.4 | 2.3 | 6.8 | 33 | 25 | 12 | 16 | 64 | 85 |

Al alloy wires of samples No. 1-1 to No. 1-23, and No. 2-1 to No. 2-23, and No. 3-1 to No. 3-12 each formed of an Al—Fe-based alloy having a specific composition containing Fe in a specific range and containing specific elements (Mg, Si, Cu, Element a) as appropriate in specific ranges and each subjected to softening treatment (which may be hereinafter collectively referred to as a softened member sample group) each have a high evaluation parameter value of the impact resistance as high as 10 J/m or more, as shown in Tables 13 to 15, as compared with Al alloy wires of samples No. 1-101 to No. 1-104, No. 2-201, and No. 3-301 (which may be hereinafter collectively referred to as a comparison sample group) each having a composition other than the above-mentioned specific compositions. Also, the Al alloy wires in the softened member sample group also have excellent strength and the higher number of times of bending, as shown in Tables 9 to 11. This shows that the Al alloy wires in the softened member sample group have excellent impact resistance and excellent fatigue characteristics in a well-balanced manner as compared with the Al alloy wires in the comparison sample group. Furthermore, the Al alloy wires in the softened member sample group are excellent in mechanical characteristics and electrical characteristics, that is, have high tensile strength and high breaking elongation, and also have high 0.2% proof stress and high electrical conductivity. Quantitatively, the Al alloy wires in the softened member sample group satisfy the conditions of: tensile strength equal to or more than 110 MPa and equal to or less than 200 MPa; 0.2% proof stress equal to or more than 40 MPa (in this case, equal to or more than 45 MPa, and in most of the samples, equal to or more than 50 MPa); breaking elongation equal to or more than 10% (in this case, equal to or more than 11%, and in most of the samples, equal to or more than 15% and equal to or more than 20%); and electrical conductivity equal to or more than 55% IACS (in most of the samples, equal to or more than 57% IACS, and equal to or more than 58% IACS). In addition, the Al alloy wires in the softened member sample group show a high ratio "proof stress/tensile" between the tensile strength and the 0.2% proof stress, which is equal to or more than 0.4. Furthermore, it turns out that the Al alloy wires in the softened member sample group are excellent in performance of fixation to the terminal portion as shown in Tables 13 to 15 (equal to or more than 40 N). As one of the reasons, it is considered that this is because the Al alloy wires in the softened member sample group each have a high work hardening exponent equal to or more than 0.05 (in most of the samples, equal to or more than 0.07, and further, equal to or more than 0.10; Tables 9 to 11), thereby excellently achieving the strength improving effect by work hardening during pressure-bonding of a crimp terminal.

The features regarding voids described below will be found by reference to the evaluation results obtained using a rectangular measurement region A and the evaluation results obtained using a sector-shaped measurement region B.

Particularly, as shown in Tables 13 to 15, in the Al alloy wires in the softened member sample group, the total area of voids existing in the surface layer is equal to or less than 2.0 $\mu m^2$, which is smaller than those of the Al alloy wires in sample No. 1-105, No. 1-106, No. 2-204, and No. 3-303 in Table 16. Focusing an attention on these voids in the surface layer, the samples having the same composition (No. 1-5, No. 1-105, No. 1-106), (No. 2-5, No. 2-204), and (No. 3-3, No. 3-303) are compared with one another. It turns out that sample No. 1-5 with the smaller amount of voids is more excellent in impact resistance (Tables 13 and 16), and also greater in number of times of bending and more excellent in fatigue characteristics (Tables 9 and 12). The same also applies to samples No. 2-5 and No. 3-3 each containing a smaller amount of voids. As one of the reasons, it is considered that this is because, in the Al alloy wires of samples No. 1-105, No. 1-106, No. 2-204, and No. 3-303 each containing a large amount of voids in the surface layer, breakage is more likely to occur due to voids as origins of cracking upon an impact or repeated bending. Based on this, it can be recognized that the impact resistance and the fatigue characteristics can be improved by reducing the voids in the surface layer of the Al alloy wire. Also as shown in Tables 13 to 15, the Al alloy wires in the softened member sample group are smaller in hydrogen content than the Al alloy wires in samples No. 1-105, No. 1-106, No. 2-204, and No. 3-303 shown in Table 16. Based on the above, one factor of voids is considered as hydrogen. The temperature of melt is relatively high in samples No. 1-105, No. 1-106, No. 2-204, and No. 3-303. Thus, it is considered that a large quantity of dissolved gas is more likely to exist in the melt. It is also considered that hydrogen derived from this dissolved gas has increased. Based on the above, it can be recognized as being effective to set the temperature of melt to be relatively low (less than 750° C. in this case) in the casting process in order to reduce the voids in the above-mentioned surface layer.

In addition, by the comparison between sample No. 1-3 and sample No. 1-10 (Table 13) and the comparison between sample No. 1-5 and sample No. 3-3 (Table 15), it turns out that hydrogen is readily reduced when Si and Cu are contained.

Furthermore, the following can be found from this test.

(1) As shown in Tables 13 to 15, the Al alloy wires in the softened member sample group each contain a small amount of voids not only in the surface layer but also inside thereof. Quantitatively, the ratio "inside/surface layer" of the total area of voids is equal to or less than 44, and in this case, equal to or less than 20, and further, equal to or less than 15, and in most of the samples, equal to or less than 10, which are smaller than that of sample No. 2-204 (Table 16). When comparing sample No. 1-4 and sample No. 1-106 having the same composition, sample No. 1-4 with a smaller ratio "inside/surface layer" is higher in number of times of bending (Tables 9 and 12) and higher in parameter value of impact resistance (Tables 13 and 16) than sample No. 1-6. As one of the reasons, it is considered that, in the Al alloy wire of sample No. 1-106 containing a relatively large amount of inside voids, cracking progresses from the surface layer toward the inside thereof through voids upon an impact or repeated bending, so that breakage is more likely to occur. In the case of sample No. 2-204, the number of times of bending of is small (Table 12) and the parameter value of impact resistance is low (Table 16). Accordingly, it can be said that the higher ratio "inside/surface layer" is more likely to cause cracking to progress toward inside, so that breakage is more likely to occur. Based on the above, it can be said that the impact resistance and the fatigue characteristics can be improved by reducing voids in the surface layer of the Al alloy wire and inside thereof. Furthermore, it can be said based on this test that the higher cooling rate is more likely to lead to a smaller ratio "inside/surface layer". Thus, in order to reduce the above-mentioned inside voids, it can be recognized as being effective to set the temperature of melt to be relatively low in the casting process and also to increase the cooling rate in the temperature range up to 650° C. to some extent (in this case, more than 0.5° C./second, and further, equal to or more than 1° C./second and equal to or less than 30° C./second, and preferably less than 25° C./second, and further, less than 20° C./second).

(2) As shown in Tables 13 to 15, the Al alloy wires in the softened member sample group show relatively small crystal grain sizes. Quantitatively, the average crystal grain size is equal to or less than 50 μm, and in most of the samples, equal to or less than 35 μm, and further, equal to or less than 30 μm, which are smaller than that of sample No. 2-203 (Table 16). When comparing sample No. 2-5 and sample No. 2-203 having the same composition, sample No. 2-5 is greater in evaluation parameter value of impact resistance (Tables 14 and 16) and also larger in number of times of bending (Tables 10 and 12) than sample No. 2-203. Thus, it is considered that a small crystal grain size contributes to improvement in impact resistance and fatigue characteristics. In addition, it can be said based on this test that the crystal grain size is readily reduced by setting the heat treatment temperature to be relatively low or by setting the retention time to be relatively short.

(3) As shown in Tables 13 to 15, the Al alloy wires in the softened member sample group each have a surface oxide film, which is relatively thin (comparatively see sample No. 2-205 in Table 16) and equal to or less than 120 nm. Thus, it is considered that these Al alloy wires can suppress the increase of the resistance of connection to the terminal portion, thereby allowing construction of a low-resistance connection structure. Furthermore, as to the covered electrical wires in the softened member sample group, the insulation cover was removed to obtain a conductor alone. Then, the strand wire or the compressed strand wire forming the conductor was unraveled into elemental wires to obtain an arbitrary one elemental wire as a sample, which was then subjected to salt spray test to check whether corrosion occurred or not by visual observation. As a result, no corrosion occurred. Under the conditions of the salt spray test, an NaCl aqueous solution of 5 mass % concentration is used and the test time period is 96 hours. Based on the above, it is considered that the surface oxide film having an appropriate thickness (equal to or more than 1 nm in this case) contributes to improvement in corrosion resistance. In addition, it can be said based on this test that a surface oxide film is more likely to be formed thicker in an air atmosphere for heat treatment such as softening treatment or under the condition allowing formation of a boehmite layer, and also that a surface oxide film is more likely to be formed thinner in a low-oxygen atmosphere.

The Al alloy wire composed of an Al—Fe-based alloy having a specific composition, subjected to softening treatment and having a surface layer containing a small amount of voids as described above has high strength, high toughness and high electrical conductivity, and is also excellent in strength of connection to the terminal portion and excellent in impact resistance and fatigue characteristics. It is expected that such an Al alloy wire can be suitably utilized for a conductor of a covered electrical wire, particularly, a conductor of a terminal-equipped electrical wire having a terminal portion attached thereto.

The present invention is defined by the terms of the claims, but not limited to the above description, and is intended to include any modifications within the meaning and scope equivalent to the terms of the claims.

For example, the composition of the alloy, the cross-sectional area of the wire member, the number of wire members stranded into a strand wire, and the manufacturing conditions (the temperature of melt, the cooling rate during casting, the timing of heat treatment, the heat treatment conditions, and the like) in Test Example 1 can be changed as appropriate.

[Clauses]

The following configuration can be employed as an aluminum alloy wire that is excellent in impact resistance and fatigue characteristics.

[Clause 1]

An aluminum alloy wire is composed of an aluminum alloy.

The aluminum alloy contains equal to or more than 0.005 mass % and equal to or less than 2.2 mass % of Fe, and a remainder of Al and an inevitable impurity.

In a transverse section of the aluminum alloy wire, a sector-shaped void measurement region of 1500 $\mu m^2$ is defined within an annular surface layer region extending from a surface of the aluminum alloy wire by 30 μm in a depth direction, and a total cross-sectional area of voids in the sector-shaped void measurement region is equal to or less than 2 $\mu m^2$.

The aluminum alloy wire described in above-mentioned [Clause 1] is more excellent in impact resistance and fatigue characteristics when at least one of the mechanical characteristics such as tensile strength, 0.2% proof stress and breaking elongation, the crystal grain size, the work hardening exponent, and the hydrogen content falls within the above-mentioned specific range. Furthermore, the aluminum alloy wire described in above-mentioned [Clause 1] is excellent in electrical conductive property when the electrical conductivity falls within the above-mentioned specific range and is excellent in corrosion resistance when the surface oxide film falls within the above-mentioned specific range. The aluminum alloy wire described in the above-mentioned [Clause 1] can be utilized for the aluminum alloy strand wire, the covered electrical wire, or the terminal-equipped electrical wire, each of which is described above.

REFERENCE SIGNS LIST

1 covered electrical wire, 10 terminal-equipped electrical wire, 2 conductor, 20 aluminum alloy strand wire, 22 aluminum alloy wire (elemental wire), 220 surface layer region, 222 surface-layer void measurement region, 224 void measurement region, 22S short side, 22L long side, P contact point, T tangent line, C straight line, g cavity, 3 insulation cover, 4 terminal portion, 40 wire barrel portion, 42 fitting portion, 44 insulation barrel portion.

The invention claimed is:

1. An aluminum alloy wire composed of an aluminum alloy, wherein the aluminum alloy contains equal to or more than 0.005 mass % and equal to or less than 2.2 mass % of Fe, and a remainder of Al and an inevitable impurity, and in a transverse section of the aluminum alloy wire, a surface-layer void measurement region in a shape of a rectangle having a short side length of 30 μm and a long side length of 50 μm is defined within a surface layer region extending from a surface of the aluminum alloy wire by 30 μm in a depth direction, and a total cross-sectional area of voids in the surface-layer void measurement region is equal to or less than 2 $\mu m^2$, and the aluminum alloy wire has a wire diameter equal to or more than 0.2 mm and equal to or less than 3.6 mm, tensile strength equal to or more than 110 MPa and equal to or less than 200 MPa, 0.2% proof stress equal to or more than 40 MPa, breaking elongation equal to or more than 10%, and electrical conductivity equal to or more than 55% IACS.

2. The aluminum alloy wire according to claim 1, wherein, in the transverse section of the aluminum alloy wire, an inside void measurement region in a shape of a rectangle having a short side length of 30 μm and a long side length of 50 μm is defined such that a center of the rectangle of the inside void measurement region coincides with a center of the aluminum alloy wire, and a ratio of a total cross-sectional area of voids in the inside void measurement region to the total cross-sectional area of the voids in the surface-layer void measurement region is equal to or more than 1.1 and equal to or less than 44.

3. The aluminum alloy wire according to claim 1, wherein the aluminum alloy further contains equal to or less than 1.0 mass % in total of one or more elements selected from Mg, Si, Cu, Mn, Ni, Zr, Ag, Cr, and Zn in respective ranges of Mg: equal to or more than 0.05 mass % and equal to or less than 0.5 mass %, Si: equal to or more than 0.03 mass % and equal to or less than 0.3 mass %, Cu: equal to or more than 0.05 mass % and equal to or less than 0.5 mass %, and Mn, Ni, Zr, Ag, Cr, and Zn: equal to or more than 0.005 mass % and equal to or less than 0.2 mass % in total.

4. The aluminum alloy wire according to claim 1, wherein the aluminum alloy further contains at least one of: equal to or more than 0 mass % and equal to or less than 0.05 mass % of Ti; and equal to or more than 0 mass % and equal to or less than 0.005 mass % of B.

5. The aluminum alloy wire according to claim 1, wherein the aluminum alloy has an average crystal grain size equal to or less than 50 μm.

6. The aluminum alloy wire according to claim 1, wherein a work hardening exponent is equal to or more than 0.05.

7. The aluminum alloy wire according to claim 1, wherein the aluminum alloy wire has a surface oxide film having a thickness of equal to or more than 1 nm and equal to or less than 120 nm.

8. The aluminum alloy wire according to claim 1, wherein a content of hydrogen is equal to or less than 4.0 ml/100 g.

9. An aluminum alloy strand wire comprising a plurality of the aluminum alloy wires according to claim 1, the plurality of the aluminum alloy wires being stranded together.

10. The aluminum alloy strand wire according to claim 9, wherein a strand pitch is equal to or more than 10 times and equal to or less than 40 times as large as a pitch diameter of the aluminum alloy strand wire.

11. A covered electrical wire comprising:

a conductor; and an insulation cover that covers an outer circumference of the conductor, wherein the conductor includes the aluminum alloy strand wire according to claim 9.

12. A terminal-equipped electrical wire comprising:

the covered electrical wire according to claim 11; and a terminal portion attached to an end portion of the covered electrical wire.

* * * * *